United States Patent [19]

Moody et al.

[11] Patent Number: 4,498,506

[45] Date of Patent: Feb. 12, 1985

[54] TOOL FOR THE AUTOMATIC INSTALLATION OF DISCRETE CABLE TIES PROVIDED ON A CONTINUOUS RIBBON OF CABLE TIES

[75] Inventors: Roy A. Moody, Flossmoor; John J. Bulanda, New Lenox; Robert F. Levin, Bollingbrook; Steven S. Timian, Lockport; Stephen A. Waltasti, Bollingbrook, all of Ill.

[73] Assignee: Panduit Corp., Tinley Park, Ill.

[21] Appl. No.: 444,495

[22] Filed: Nov. 24, 1982

[51] Int. Cl.[3] ..... B21F 9/02

[52] U.S. Cl. ..... 140/93.2; 140/93 A

[58] Field of Search ..... 140/93.2, 93 A, 123.6

[56] References Cited

U.S. PATENT DOCUMENTS

| | | | |
|---|---|---|---|
| 3,103,666 | 9/1963 | Bone | 227/67 |
| 3,759,435 | 9/1973 | Bone | 227/67 |
| 3,946,769 | 3/1976 | Caveney et al. | 140/93.2 |
| 3,976,108 | 8/1976 | Coveney et al. | 140/93 A |
| 4,004,618 | 1/1977 | Turek | 140/93.2 |
| 4,359,070 | 11/1982 | Hidassy et al. | 140/93 A |

*Primary Examiner*—Francis S. Husar
*Assistant Examiner*—Linda McLaughlin
*Attorney, Agent, or Firm*—Charles R. Wentzel; Mark D. Hilliard

[57] ABSTRACT

An automatic cable tie installation tool for applying discrete cable ties around bundles of wires or the like where the cable ties are provided to the tool on a continuous ribbon. The automatic tool including a dispenser mechanism that accepts the ribbon of cable ties and provides discrete cable ties therefrom; a tool mechanism that positions the discrete cable tie around the bundle of wire, tensions the tie to a preselected value and severs the tail of the cable tie; and a conveyance mechanism that delivers the cable tie provided by the dispenser mechanism to the tool mechanism. The dispenser mechanism including a reel mechanism for providing the cable tie ribbon to the dispenser mechanism, a grooved cylinder that carries individual cable ties for positioning and translating the ribbon longitudinally, an index mechanism for rotating the cylinder in accurate increments, a mechanism for separating individual cable ties from the ribbon, a guide mechanism for positioning the ribbon laterally relative to the separation means and a mechanism for transferring the separated cable ties to the conveyance mechanism. The ribbon includes a strip portion extending the length of the ribbon having a plurality of cable ties connected thereto by respective connecting tabs. The strip portion having an alignment mechanism adapted to cooperate with the guide mechanism in the dispenser to accurately position the ribbon laterally in the dispenser mechanism.

20 Claims, 28 Drawing Figures

23A
23B
23C
23D
23E

SNA
SNB
SNC
SW1
CN1
CN2
CN3
CN4
CN5
VDD
VDD
TO FIG. 23B
DB1
TO VCC
VDD
CHASSIS
SND
SW4
SW3
TO FIG. 23D

OB1
OB2
OB3
OB4
OB5
OB6
OB7
LED1
LED2
LED3
LED4
LED5
LED6
LED7
S1
S2
S3
S4
S5
S6
S7
S8
S9
CHASSIS
TO FIG. 23B
TO FIG. 23E

TOOL FOR THE AUTOMATIC INSTALLATION OF DISCRETE CABLE TIES PROVIDED ON A CONTINUOUS RIBBON OF CABLE TIES

BACKGROUND OF THE INVENTION

The present invention relates generally to the application of cable ties to wire bundles or the like and specifically to a tool that automatically dispenses, conveys and applies discrete cable ties to wire bundles or the like, where the cable ties are provided on a continuous ribbon.

Prior automatic cable tie installation tools have utilized a cartridge to contain a number of discrete cable ties and provide the cable ties sequentially to a dispenser mechanism in the tool. The use of a cartridge to feed discrete cable ties to an automatic cable tie installation tool presents inherent limitations and operational difficulties that limit the efficiency of the tool.

Any tool utilizing a cartridge has the inherent limitation of only being able to apply as many cable ties as the cartridge is designed to hold. Application by the tool of all the ties in the cartridge necessitates the exchange of the empty cartridge for a loaded cartridge or the manual refilling of the empty cartridge. Practical design constraints dictated by the dimensions of the cable ties and the need for a portable and easily operable automatic tool have limited the number of cable ties carried in an individual cartridge to approximately one hundred cable ties.

Prior tools also require the cable ties to be loaded into each cartridge in a specific and consistent orientation, requiring careful and time consuming manipulation of individual cable ties during the cartridge loading operation.

Compounding the above described inefficiencies is the fact that cartridge supplied tools inherently have complex mechanisms to allow the detachable mounting of a cartridge and to sequentially dispense cable ties from the cartridge. Such mechanisms must meet close tolerances in manufacture and fit and must be carefully operated and maintained in order to provide error free operation. Due to these constraints, prior tools have failed to operate flawlessly during the attachment of new cartridges. The tools often will jam during the loading of a cartridge requiring the waste of operator time to unjam and properly reload the tool.

All of the above problems contribute to a loss of overall efficiency in the prior automatic cable tie installation tools; a significant portion of an operator's time being devoted to the loading of cartridges instead of to the application of cable ties.

Additional problems inherent in supplying cable ties by cartridge include the increased costs due to manufacture, storage and disposal of the cartridge.

Another problem of prior art tools is the use of mechanical or pneumatic logic to control the many sequential operational steps necessary to dispense, convey and supply a cable tie. The use of mechanical and pneumatic systems to control the various actions of a tool requires the use of a large number of interacting valves, linkages, etc. with the concomitant expense of manufacture and expense of maintenance that a tool having a large number of interacting mechnical components entails.

Additionally, pneumatic logic systems are inherently sensitive to variance in pressure of their control fluid or to contamination of their control fluid, either of which can cause timing errors in the control system. Due to the high speed at which automatic cable tie installation tools complete a cycle, small errors in control logic timing can result in the failure of the control logic to actuate the mechanisms of the tool in proper operational order with the attendant failure of the tool.

Prior automatic cable tie installation tools have pneumatically conveyed the ties provided by the cartridge through a tube at high velocity to a remote hand tool where the tie is positioned around a bundle of wire and installed. Successful receipt of the tie by the remote tool requires the tie to be brought to rest at the correct position within the remote hand tool, relative to the other working mechanisms of the hand tool. Typically, a head stop or abutment has been provided to stop and correctly position the tie. The head stop being positioned to inhibit the forward motion of the tie by interferingly stopping the head of the tie.

The problem of intermittent destruction of the cable tie due to the abrupt impact of the tie head against the head stop was experienced and was addressed in the commonly assigned U.S. Pat. No. 4,004,618. U.S. Pat. No. 4,004,618 discloses a pair of resilient steel arms that act as a brake to decrease the velocity of the tie before it strikes the head abutment thus decreasing the probability of tie fragmentation upon impact. The arms were also positioned to prevent retrograde movement of the tie after it had passed by the arms.

Although the above mentioned disclosure describes one structure that will decrease the probability of impact induced destruction of a pneumatically delivered cable tie, certain problems are encountered with the use of resilient steel arms. One problem is that the continued flexing of the steel arms caused by a passing tie results in outward deformation of the arms destroying their braking efficiency and eventually results in failure of the steel arms due to fatigue. Additionally, although the arms prevent retrograde movement of the tie, they do not positively lock the tie in position. Thus, a need exists for an improved tie braking and tie positioning mechanism, that will have increased efficiency, reliability and simplicity.

SUMMARY OF THE INVENTION

It is therefore an object of the present invention to provide a cable tie installation tool that automatically accepts a reel of cable ties mounted on an edge strip, that sequentially separates each cable tie from the reel and conveys the discrete cable tie to a remote installation tool where the cable tie is automatically installed around a bundle of wire or the like, tensioned at a predetermined value and the tail of the cable tie is severed and ejected.

It is another object of the present invention to provide a cable tie installation tool that has the ability to process large numbers of cable ties before reloading of the tool is necessary.

It is a further object of the present invention to provide a cable tie installation tool that so greatly decreases the amount of operator time that must be devoted to loading cable ties as to make the time spent loading the tool an insignificant factor in the operational efficiency of the tool.

It is another object of the present invention to provide a ribbon of cable ties mounted on an alignment strip that ensures error free loading, alignment and long operation of the cable tie installation tool.

It is an additional object of the present invention to provide a cable tie installation tool that utilizes solid state electronic control logic and solid state electronic sensors to ensure safe and reliable control of the tool.

It is another object of the present invention to provide a cable tie installation tool having electronic sensors positioned to observe the action of the critical tool mechanisms and provide this information to the control logic where the information is utilized to ensure proper tool operation and the operator's safety.

It is an additional object of the present invention to provide a cable tie installation tool that only supplies fluid pressure to the remote installation tool as is needed to perform the operation cycle, thus eliminating the need for a constant supply of pressure to the installation tool and increasing operator safety.

It is a further object of the present invention to provide a cable tie installation tool having fewer interacting mechanical components, thus increasing the simplicity and decreasing the manufacturing and maintenance costs of the tool.

It is another object of the present invention to provide a cable tie installation tool having an improved braking mechanism that brakes a pneumatically propelled tie and resiliently grips the head of the tie in the proper position for insertion of the distal end of the strap of the tie through the head.

It is an additional object of the present invention to provide a cable tie installation tool having an improved braking mechanism that exhibits the characteristics of increased reliability and increased service life.

These and other objects, together with the advantages thereof over existing prior art forms, which will become apparent from the following specification, are accomplished by means hereinafter described.

In general, the automatic cable tie installation tool of the present invention includes a dispensing mechanism for accepting a ribbon of cable ties and providing therefrom discrete cable ties to a conveyance means which delivers each discrete cable tie to a tool mechanism that positions, tensions and severs the tail of the cable tie around a bundle of wire or the like. The tool mechanism is provided with an improved braking mechanism having opposed resiliently biased brake pads that present inclined brake ramps to slow the pneumatically propelled cable tie and gripping tabs that resiliently grip and position the cable tie within the tool mechanism. The ribbon utilized in the autmatic cable tie installation tool in general includes a strip portion extending the length of said ribbon, a plurality of cable ties each having a locking head portion and a strap portion. The strip portion being connected to the heads of each cable tie by a tab. Affixed along the length of the strip portion are a plurality of alignment projections that provide accurate alignment reference guidance for alignment of the ribbon with the automatic cable tie installation tool.

DESCRIPTION OF THE PREFERRED EMBODIMENT

Figure 1:
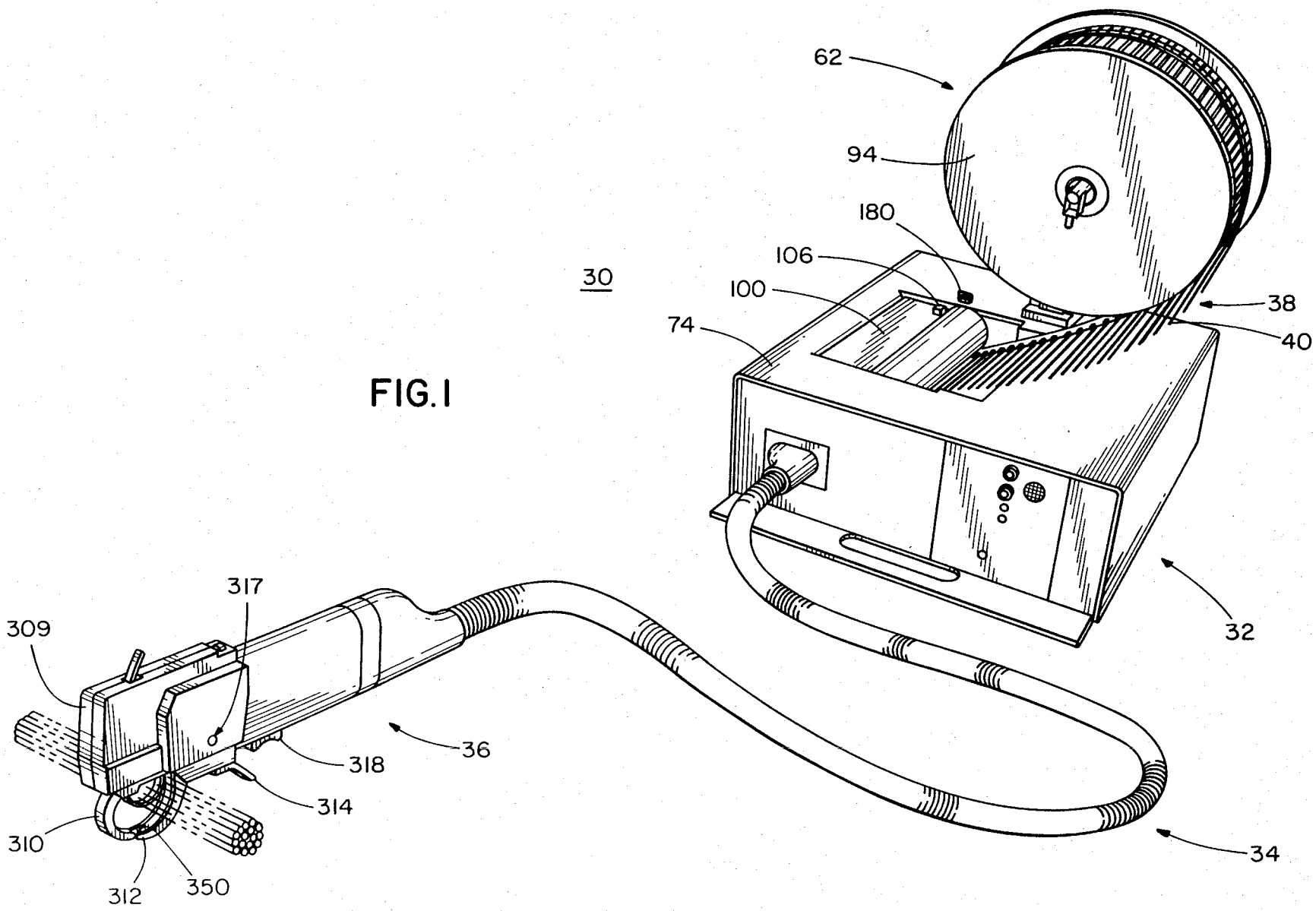
FIG. 1 is a perspective view of an automatic cable tie installation tool embodying the concept of the present invention, the automatic tool having a dispenser mechanism, a conveyance mechanism and a remote tool mechanism.

An automatic cable tie installation tool embodying the concept of the present invention is generally indicated by the numeral 30 in the accompanying drawings. As best seen in FIG. 1, the automatic tool 30 includes a dispenser mechanism 32, a conveyance mechanism 34 and a remote tool 36.

The dispenser mechanism 32 accepts a ribbon 38 of cable ties 40 and sequentially dispenses individual ties 40 to conveyance mechanism 34. The conveyance mechanism 34 delivers the individual ties 40 to remote tool 36. Remote tool 36 then positions each tie 40 around a bundle of wire or the like, tensions tie 40 to a predetermined value and then severs the tail of tie 40. It should be understood that the concept of the present invention is not limited to the provision of a remote tool, but encompasses an automatic tool 30 wherein the dispenser 32 is integral with and supported by tool 36.

Figure 2:
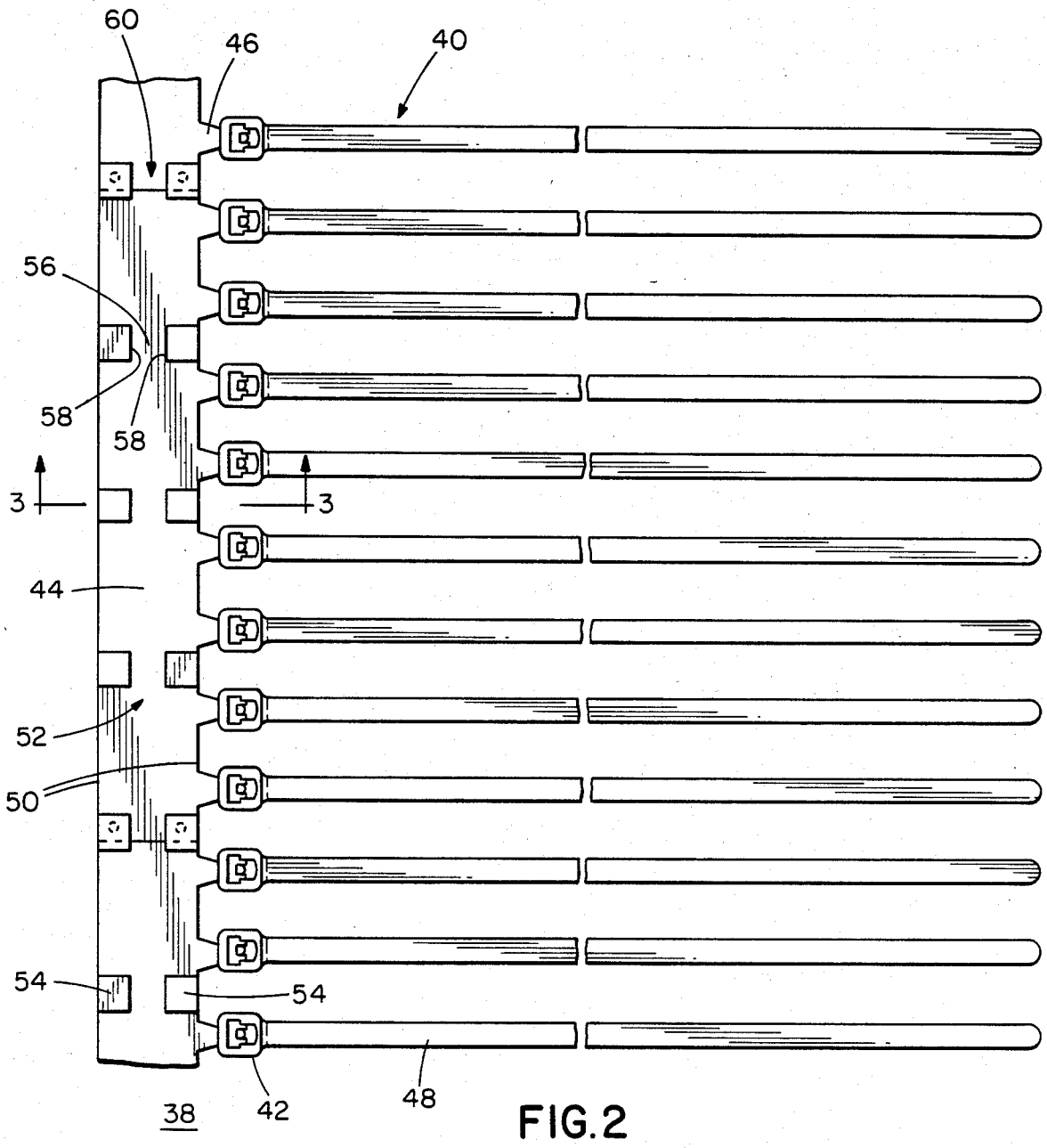
FIG. 2 is a top view of a planar ribbon of cable ties embodying the concept of the present invention.
Figure 3:
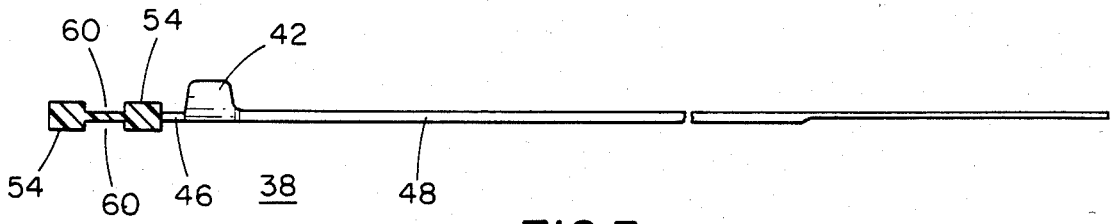
FIG. 3 is a sectional view of the ribbon in FIG. 2 taken along line 3—3 of FIG. 2.

The ribbon 38, as best seen in FIGS. 2 and 3, includes a plurality of cable ties 40 each mounted at their heads 42 to strip portion 44 by a tab 46. The ties 40 are equally spaced along the length of strip portion 44 with each cable tie's medial longitudinal axis being in parallel disposition to each other tie 40 and each tie 40 forming a right angle with the longitudinal axis of strip portion 44.

Figure 9:
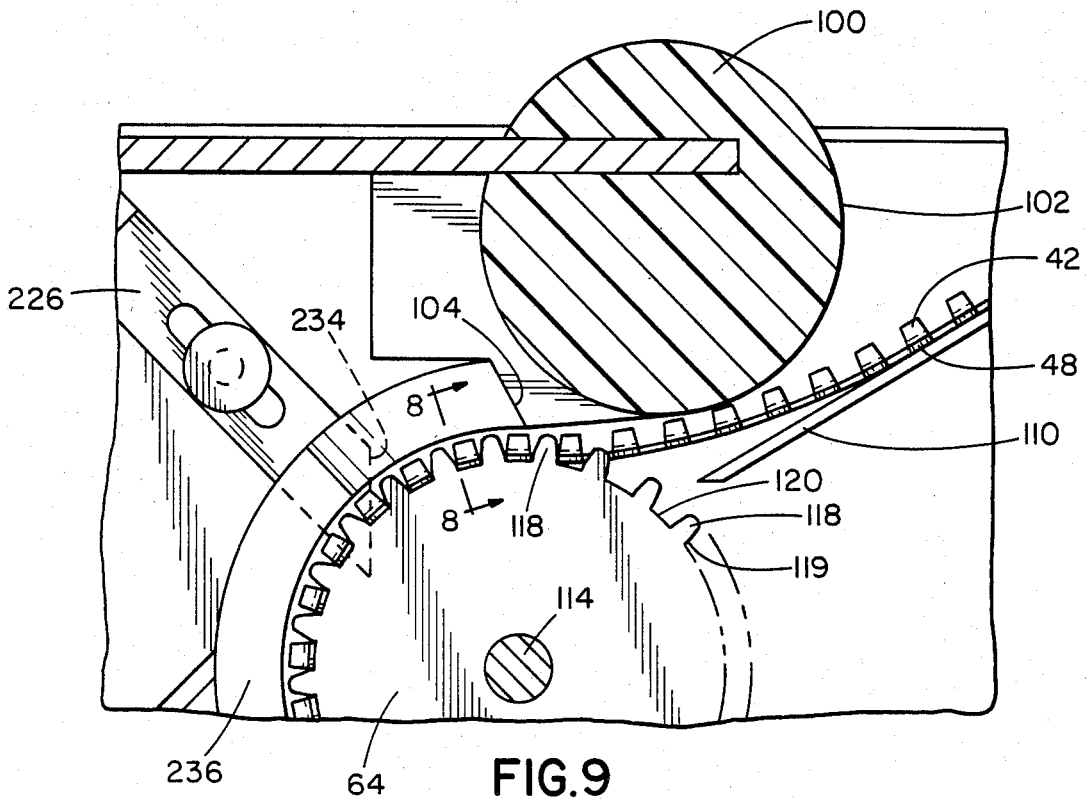
FIG. 9 is a partial sectional view of the dispenser mechanism of FIG. 5 taken along line 9—9 of FIG. 5.

The ties 40 are of normal one piece construction having a locking head 42 and a strap 48 that inserts into head 42 to be locked therein. As seen in FIG. 9, the head 42 of each tie 40 tapers from a greater width in the plane of strap 48 to a smaller width in a parallel plane above the strap 48. The thickness of each head 42 of each tie 40 is approximately three times the thickness of strap 48. The strap 48 being approximately equal in thickness to strip portion 44 and being located substantially in the same plane. Each head 42 thus projects above the strap 48 and strip portion 44; the heads 42 of the plurality of ties 40 in ribbon 38 forming a projecting discontinuous ridge running the length of ribbon 38.

The ties 40 are connected to strip portion 44 by tabs 46. Each tab 46 is located in the same plane as strip portion 44 and is of approximately the same thickness. The tabs 46 are trapezoidal in shape, tapering from a wider end adjacent strip portion 44 to a narrower end adjacent head 42.

The strip portion 44 is defined by two parallel edges 50; the inner edge 50 being contiguous to tabs 46 and the outer edge 50 having no substantial discontinuities. The width of strip portion 44 is approximately twice the length of head 42. The length of strip portion 44 is defined by the length of ribbon 38. The thickness of strip portion 44 is sized dependent upon its material, to provide sufficent flexibility to allow ribbon 38 to be coiled on a dispensing reel but with sufficient rigidity to define a substantially planar ribbon 38.

Positioned on both planar sides and along the length of strip portion 44 are alignment guides 52. Alignment guides 52 each include two square projecting surfaces 54. The surfaces 54 are formed in line with each abutting a different edge 50 of strip portion 44. The sufaces 54 are each approximately one third the width of strip portion 44, the two surfaces 54 together defining a channel area 56 interposed between the two surfaces 54 that is approximately one third the width of strip portion 44. The surfaces 54 have opposing inner sides that define two alignment edges 58. The alignment edges 58 are colinear with the respective alignment edges 58 of each successive alignment guide 52 on strip portion 44 and are parallel to each other, defining a discontinuous alignment channel 60 running the length of strip portion 44. The alignment edges 58 allow accurate lateral alignment of ribbon 38, alignment edges 58 providing opposing alignment surfaces thus allowing positioning of ribbon 38 in both lateral directions. Successive alignment guides 52 are equally spaced along the length of strip portion 44 having two ties 40 interposed therebetween.

In preferred form, each alignment guide 52 on one planar side of the strip portion 44 is juxtaposed with a reflecting alignment guide 52 on the opposite planar side of the strip portion 44, thus defining two alignment channels 60 positioned on opposing planar sides of strip portion 44.

Ribbon 38 is preferably manufactured as a one piece thermoplastic ribbon; ties 40, tabs 46 and strip portion 44 all being integrally molded of the same material. Manufacture of ribbon 38 is effected by molding incremental lengths of ribbon 38 and joining the distal end of strip portion 44 of each incremental length of ribbon 38 to the distal end of strip portion 44 of a successive incremental length of ribbon 38. In preferred construction, the connection of the incremental lengths of ribbon 38 is accomplished as each new incremental length of ribbon 38 is molded; the trailing end of strip portion 44 of the last molded incremental length of ribbon 38 being held within the incremental ribbon mold, while the strip portion 44 of the next succeeding incremental length of ribbon 38 is fixedly molded to this trailing end. The strip portion 44 of each incremental length of ribbon 38 can be molded with bores disposed proximate the trailing end of each strip portion 44 whereby material from the next succeeding molded incremental length of ribbon 38 will fill the bores and provide a secure connection between the contiguous incremental lengths of ribbon 38. It should be understood that other methods of securely mounting cable ties to an aligning strip also are within the concept of the present invention. For example, discretely manufactured cable ties may be secured to a carrier strip in the same structural configuration as described above by adhesive or by interference fit between each tie and the carrier strip.

Figure 4:
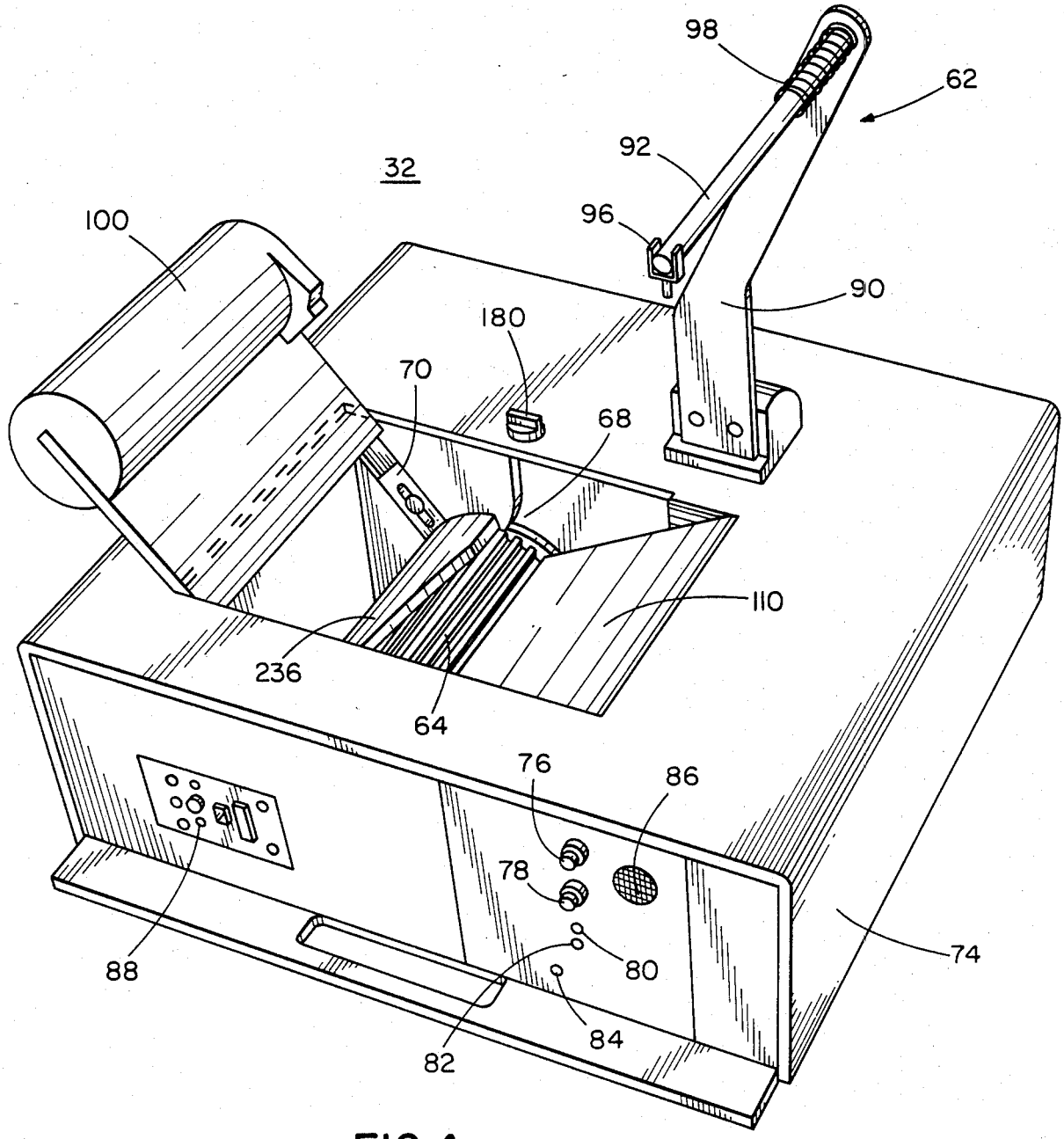
FIG. 4 is a perspective view of the dispenser mechanism of FIG. 1 with the dispenser's load door being disposed in the open position.
Figure 5:
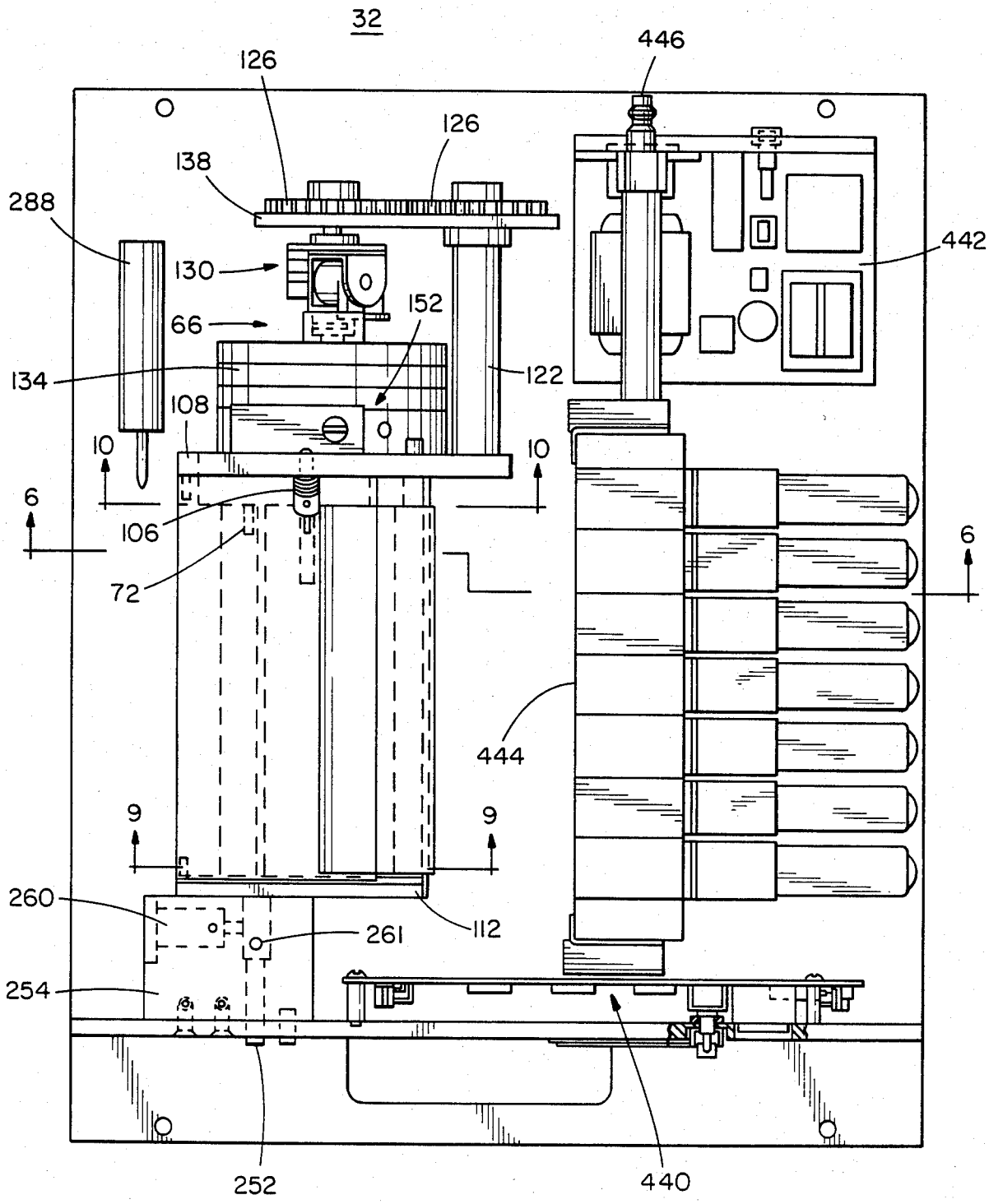
FIG. 5 is a top view of the dispenser mechanism of FIG. 4 as seen with the dispenser housing removed.

Referring now to FIGS. 1, 4 and 5, dispenser mechanism 32 generally includes a reel mechanism 62 for providing ribbon 38 to dispenser mechanism 32, a grooved cylinder 64 that accurately positions and carries the individual ties 40, an index mechanism 66 that drives the cylinder 64, a guide mechanism 68 that cooperates with the strip portion 44 of ribbon 38 to accurately position the ribbon 38 in dispenser mechanism 32, a knife 70 that separates individual ties 40 from ribbon 38, and a transfer mechanism 72 that delivers discrete separated ties 40 upon demand.

The dispenser mechanism 32 is enclosed in a housing 74. The housing 74 having a reset button 76, a load button 78, a light emitting diode 80 for indicating a check loading condition, a light emitting diode 82 for indicating a check hose/empty condition, a light emitting diode 84 for indicating a power on condition and an audible warning buzzer 86; all proximately located on the front side of housing for ease of inspection by the operator of automatic tool 30. Also located on the front of housing 74 is a connector port 88 designed to mate with conveyance mechanism 34.

The reel mechanism 62, as best seen in FIGS. 1 and 4, is mounted on dispenser housing 74 of dispenser mechanism 32. The reel mechanism 62 includes a bracket 90 mounted to dispenser housing 74 by suitable fasteners at its lower end and having a reel arm 92 non-rotatably mounted in a bore at its upper end. The reel arm 92 is positioned with its axis parallel to the axis of cylinder 64. The reel arm 92 is a smooth cylindrical bar sized to accept and rotatably mount reel 94 that carries the coiled ribbon 38. The distal end of reel arm 92 carries a removable retaining pin 96 which limits the outward movement of mounted reel 94. A spring 98 is coaxially carried on reel arm 92, being sized to apply a tensioning force against reel 94 to restrain free rotation of reel 94 while allowing the cylinder 64 to withdraw ribbon 38 from reel 94. The reel 94 is mounted on reel arm 92 having strip portion 44 placed inwardly and aligned with guide mechanism 68.

As seen in FIGS. 4, 5 and 9 a pivotally mounted dispenser load door 100 is mounted above cylinder 64. The door 100 has a substantially cylindrical forward contour 102 that helps guide ribbon 38 into cylinder 64 and an angular shaped back contour 104 that mates with cover 236. The door 100 can be pivoted upwardly from cylinder 64 to facilitate loading and downwardly into position over the cylinder 64 to act as a guide for ribbon 38 and to shield cylinder 64 from the introduction of foreign objects. Mounted proximate door 100 is an electrical load door safety switch (not shown) that provides a signal indicating whether door 100 is open or closed. The load door 100 is provided with a latch 106, as seen in FIG. 5, that selectively locks the door 100 in a closed position by insertion of a pin through a first mounting wall 108. The load door safety switch can be positioned in a known manner to sense whether door 100 is locked in the closed position. Also providing guidance to ribbon 38 is an inclined ramp 110 of housing 74 that projects from the top of housing 74 towards cylinder 64. The ramp 110 helps support and guide ribbon 38 as it is drawn into mating engagement with cylinder 64 from reel mechanism 62.

Figure 7:
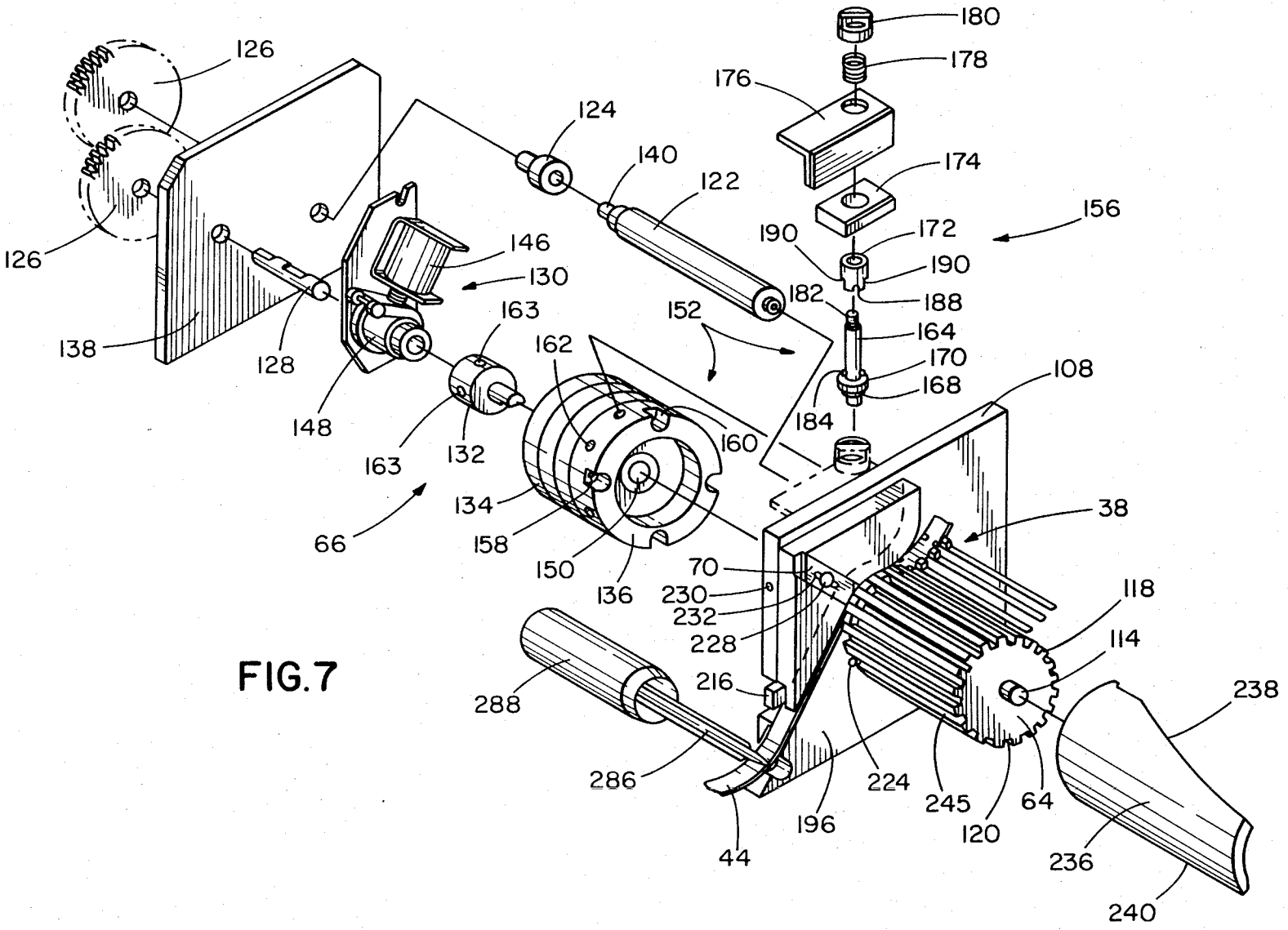
FIG. 7 is an exploded perspective of the dispenser mechanism of FIG. 5.

As seen in FIGS. 5 and 7, grooved cylinder 64 is rotatably mounted between first mounting wall 108 and a second mounting wall 112 on bearings (not shown) by an axle 114. The axle extends through a bore in first mounting wall 108 and presents a splined end (not shown) by which it is secured to index mechanism 66. The cylinder 64 has a plurality of splines 118 that define a plurality of grooves 120. The grooves 120 run the length of cylinder 64 being slightly greater in depth than the height of heads 42 of ties 40 and being slightly longer than the length of ties 40. As seen in FIG. 9, splines 118 present a contour having flat surface portions 119 that facilitate the mating acceptance of heads 42 of ties 40; the width of the grooves 120 at their deepest point being slightly wider than the greatest width of tie 40. Ribbon 38 is driven by the mating interaction of heads 42 of ties 40 with grooves 120; grooves 120 accurately longitudinally positioning and driving the head 42 of each cable tie 40, thereby longitudinally positioning and driving ribbon 38.

The index mechanism 66 includes a dispenser air motor 122, a gear adaptor 124, drive gears 126, drive shaft 128, single revolution clutch 130, clutch drive adaptor 132, planetary gear assembly 134 and an index ring 136. The index mechanism 66 rotates the cylinder 64 in accurate increments of fractions of one revolution in order to sequentially carry ribbon 38 to knife 70 and transfer mechanism 72. In preferred construction the cylinder 64 presents twenty-five grooves equally spaced around its circumference, each of which is sized relative to ribbon 38 to carry one tie 40. The cylinder 64 in FIG. 7 being depicted having nineteen grooves for clarity. Thus in order to sequentially present each tie 40 to the stationary transfer mechanism 72, cylinder 64 must be accurately rotated 1/25 of one complete revolution.

Dispenser air motor 122 is a standard pneumatic motor and is mounted between first mounting wall 108 and a third mounting wall 138. Application of pressurized air to dispenser air motor 122 drives the motor's shaft 140 which is non-rotatably affixed to gear adaptor 124. The gear adaptor 124 rotatably drives intermeshed drive gears 126, the second of which in turn rotates drive shaft 128.

The dispenser air motor 122, through drive shaft 128, supplies continuous rotational input to single revolution clutch 130 which selectively transfers rotational motion to planetary gear assembly 134 through clutch drive adaptor 132 in one revolution increments. The single revolution clutch 130 is a standard component having a solenoid actuator 146 and a wrapped spring clutch 148. Application of electrical power to solenoid 146 actuates clutch 148 which drives clutch drive adaptor 132 for exactly one revolution. It should be understood that the use of other components to supply accurate incremental rotational input, for example the use of an electrical stepper motor, are consistent with the concept of the present invention.

The clutch drive adaptor 132 drives the planetary gear assembly 134; the forward end of clutch driver adaptor 132 non-rotatably mating with the sun gear of the first stage of planetary gear assembly 134. The planetary gear assembly 134 is constructed of standard components manufactured by Matex Products, Inc., Cleveland, Ohio, consisting of two in line 5:1 planetary gear stages, Model Nos. 75-M5A and 75-M5B, separated by a standard coupling ring, Model No. 75CR, that are designed to reduce one revolution of input supplied by clutch drive adaptor 132, to 1/25 of a revolution of output which is then supplied to cylinder 64. Each planetary gear stage includes an axially disposed sun gear surrounded by three intermeshing planetary gears that intermesh with an encircling ring gear. The planetary gears of each stage are each rotatably carried on a spider. Input supplied by the clutch drive adaptor 132 is supplied to the first stage sun gear which drives the first stage planetary gears, rotating the first stage spider. The first stage spider non-rotatably carries the second stage sun gear; rotation of the first stage spider effecting rotation in the second stage sun gear. The second stage sun gear drives the second stage planetary gears within the intermeshed second stage ring gear and thus rotates the second stage spider. The second stage spider presents a splined output 150 that matingly connects with the splined end of cylinder axle 114.

The planetary gear assembly 134 is non-rotatably affixed to first mounting wall 108 by a detachment mechanism 152 including index ring 136 and a locking pin assembly 156. The index ring 136 is affixed to the ring gears of both stages of planetary gear assembly 134 by fasteners 158 that project through bores in the ring gears and planetary gear assembly 134 at counter-bores 160.

The index ring 136 has a plurality of index bores 162 equally spaced around its circumference that accept locking pin assembly 156. In order to maintain the proper alignment between clutch 148 and grooved cylinder 64, the number of index bores 162 should be any multiple of the actual sun-to-planet reduction in a single planetary stage, for example if single stage total reduction is 5:1, then sun-to-planet reduction is actually 4:1 and any multiple of 4 holes in index ring 136 would provide a correct number of equally spaced index bores 162.

The ring gears of planetary gear assembly 134 and index ring 136 can be selectively locked from rotation by locking pin assembly 156. Initial alignment of cylinder 64 relative to single revolution clutch 130 is effected by correctly aligning cylinder 64 with orifice 224 and exit orifice 246 while locking pin assembly 156 locks planetary gear assembly 134 from movement and while set screws 163 are loosened allowing relative positional movement between clutch drive adaptors 132 and clutch 148; and by subsequent tightening of set screws 163 to secure clutch drive adaptor 132 to the output end of clutch 148. When planetary gear assembly 134 is so aligned and locked, the proper alignment between clutch 148 and cylinder 64 is ensured, rotation of clutch drive adaptor 132 resulting in positive movement in splined output 150 of planetary gear assembly 134. Disengagement of the locking pin assembly 156 allows the free rotation of the ring gears. When the ring gears are free to rotate, the grooved cylinder 64 is no longer directly driven by the clutch drive adaptor 132 and cylinder 64 is free to rotate. Rotation of cylinder 64 merely results in the rotation of the ring gears of planetary gear assembly 134. Upon engagement of the locking pin assembly 156 in any of the index bores 162, cylinder 64 is again aligned with and directly driven by clutch 148. Thus, cylinder 64 can be selectively disengaged from index mechanism 66, manually rotated during the loading of ribbon 38 and engaged to index mechanism 66 in the proper alignment.

Mounted to the first mounting wall 108 in a position to matingly insert into index bores 162 is locking pin assembly 156 which includes a pin 164, a retaining ring 168, a washer 170, notched spacer 172, block 174, mounting angle 176, spring 178 and a handle 180. The pin 164 has at its upper end threads 182 that mate with a corresponding threaded bore in handle 180. Towards the lower end of pin 164 are lugs 184 positioned in a line normal to the axis of the pin 164 and a retainer groove (not shown) positioned below lugs 184. The spacer 172 and block 174 include a cylindrical spacer 172 affixed to a metal block which has a bore to communicate with spacer 172. The spacer 172 has a pair of opposing shallow notches 188 and a pair of opposing deep notches 190, both pairs being sized and positioned to mate with lugs 184 of pin 164. Mounting angle 176 includes an angle iron mount that is affixed to first mounting wall 108 having a bore to accept pin 164 which is positioned to communicate with the bore in spacer 172 and block 174 and having a counter-bore to accept handle 180. Spring 178, washer 170 and retaining ring 168 are of normal construction and are sized to be carried on pin 164.

Washer 170 is carried on the lower end of pin 164 where it is retained between retaining ring 168 and lugs 184. Pin 164 inserts through spacer 172 and block 174, mounting angle 176 and spring 178, where it is threadingly affixed to handle 180. The block 174 is positioned along and adjacent to the mounting angle 176 so as to be non-rotatingly mounted.

Spring 178 biases pin 164 upwardly against the notched spacer 172. By exerting force on handle 180 against the bias of pin 164 and rotating handle 180, lugs 184 can be placed matingly within deep notches 190 to shorten the affective length of locking pin assembly 156 or placed within shallow notches 188 to lengthen locking pin assembly 156. Thus, pin 164 can be selectively inserted into index bores 162. An electrical switch (not shown) is mounted in a position to provide a signal indicating whether or not pin 164 is locked in one of the index bores 162; the electrical switch being of normal construction, having an actuation arm the movement of which actuates the switch to an off or on state. The actuation arm can be disposed to interact with washer 170 to sense whether pin 164 is locked in an index bore 162.

Figure 8:
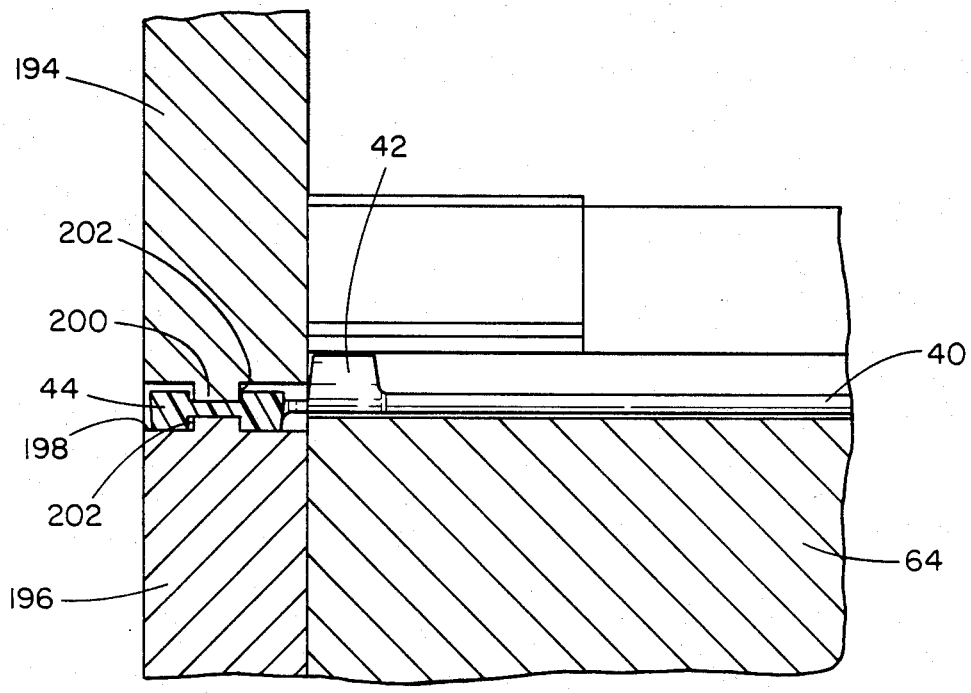
FIG. 8 is a partial sectional view of the ribbon and the upper and lower guide plates of the dispenser mechanism as taken along line 8—8 of FIG. 9.
Figure 10:
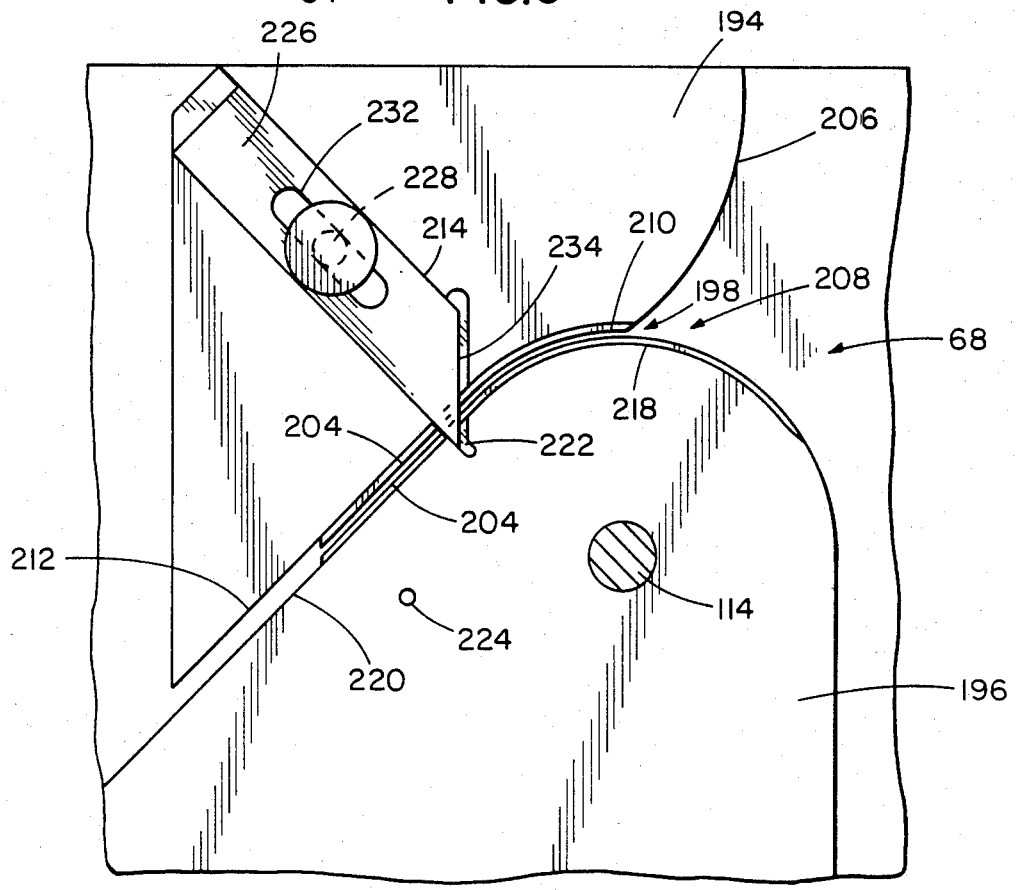
FIG. 10 is a partial sectional view of the upper and lower guide plates of the dispenser mechanism of FIG. 5 as taken along line 10—10 of FIG. 5.
Figure 11:
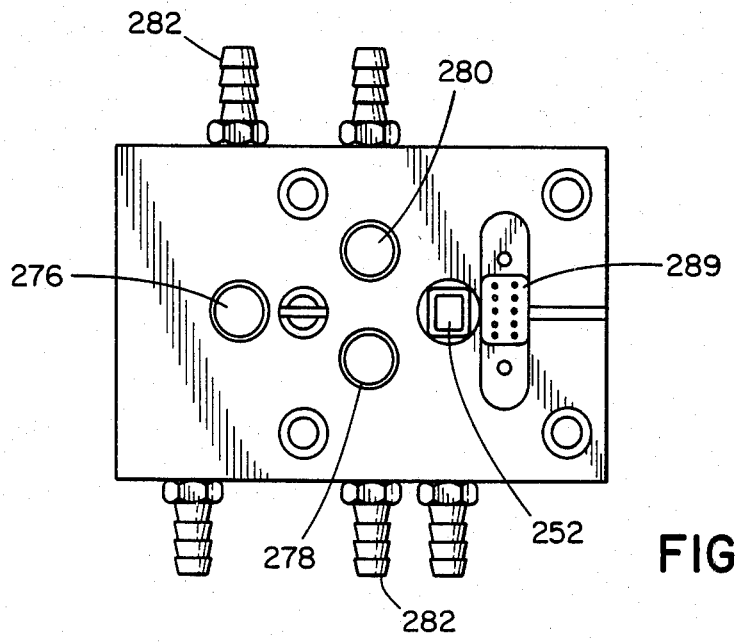
FIG. 11 is a front view of a manifold block of the dispenser mechanism.
Figure 12:
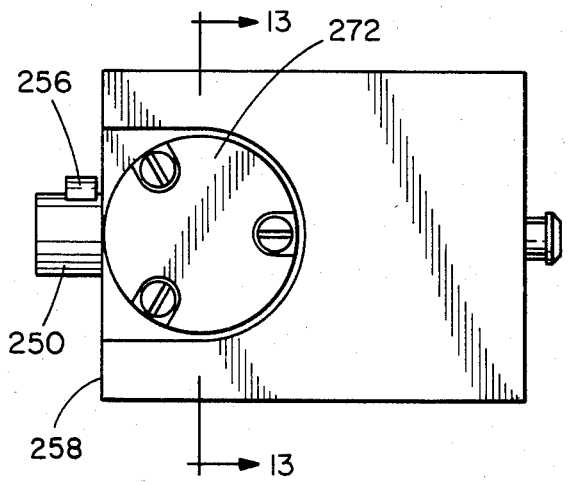
FIG. 12 is a side view of the manifold block of FIG. 11, not showing the pneumatic fittings of the manifold block.

Referring now to FIGS. 7, 8 and 10, guide mechanism 68 includes an upper guide plate 194 and a lower guide plate 196 that together matingly define an I-shaped channel 198 having flanges 200 that each provide alignment edges 202 sized to matingly carry and position strip portion 44 of ribbon 38. The upper and lower guide plates 194 and 196 are positioned parallel to and affixed to first mounting wall 108, adjacent cylinder 64. The upper and lower guide plates 194 and 196 have complimentary edges 204 that together define the path of ribbon 38 and strip portion 44.

As seen in FIGS. 7 and 10, upper guide plate 194 is positioned above the cylinder 64, its edge 204 having a forward bluntly curved portion 206 that is positioned away from lower guide plate 194 to define a mouth 208 to initially accept and guide ribbon 38 into position with cylinder 64 and channel 198, an intermediate portion 210 that follows the curve of cylinder 64 to position ties 40 thereon and an inclined portion 212 projecting downwardly defining the path of strip portion 44 after ties 40 have been severed. In the face of upper guide plate 194 adjacent cylinder 64 is a knife kerf 214. Knife kerf 214 projects downwardly at approximately a forty-five degree angle to the horizontal plane, in a line that intersects the center of axle 114 of cylinder 64. The lower corner of upper guide plate 194 presents a notch 216 onto which is mounted a photoelectric strip sensor positioned to detect the absence of strip portion 44 of ribbon 38.

The lower guide plate 196 is positioned below upper guide plate 194 its edge 204 having a forward portion 218 that approximates the inner circumference of grooves 120 and an inclined portion 220 that matingly follows edge 204 of upper guide plate 194. The lower guide plate 196 also has a knife kerf 222 positioned in line with upper guide plate's knife kerf 214 on its surface adjacent the cylinder 64 and an orifice 224 of transfer mechanism 72 that is positioned to align with one of the grooves 120 when the groove 120 is in the horizontal plane that intersects cylinder axle 114.

Knife 70 includes a blade 226 adjustably mounted in knife kerf 214 by screw 228 that attaches blade 226 to a rod (not shown). The rod is slidably mounted in a bore through first mounting wall 108 and upper guide plate 194 that communicates with the knife kerf 214. A set screw 230 is mounted transverse to the rod in first mounting wall 108 in such a manner to interferingly secure the rod from movement. Positional adjustment of knife 70 is accomplished by loosening set screw 230 and repositioning the rod. The blade 226 has a medical mounting slot 232 for accepting the screw 228 and an angular cutting edge 234 for severing tie 40 from ribbon 38. The knife blade 226 is positioned transverse to the ribbon 38, lying in a plane parallel to the face of upper and lower guide plates 194 and 196, between upper and lower guide plates 194 and 196 and cylinder 64. The angled tip of cutting edge 234 projects past the channel 198, presenting an angled cutting edge 234 normal to the outer end of head 42 of tie 40. Movement of tie 40 past the angled cutting edge 234 results in a slicing cutting action which cleanly separates tie 40 from ribbon 38.

The accurate lateral positioning of heads 42 of ties 40 relative to the blade 226 is ensured by the aligning cooperation of alignment guides 52 on strip portion 44 of ribbon 38 and alignment edges 202 of I-shaped channel 198 as seen in FIG. 8. Additionally, the shape of tab 46, being smaller in width near head 42 of tie 40 facilitates the separation of head 42 from tab 46 close to the head 42. Fine adjustments to the position of blade 226 relative to head 42 of tie 40 can also be made by set screw 230, allowing the operator to compensate for inherent tolerance variations. Thus the present invention ensures that the discrete cable ties 40 provided by dispenser mechanism 32 present a cable tie 40 having a substantially smooth head 42.

Positioned in mating proximity to cylinder 64 is cover 236. Cover 236 is a partial section of a cylindrical shell having its inner diameter sized to mate with the outer diameter of cylinder 64. Cover 236 is equal in length to cylinder 64 and extends from a first edge 238 at approximately the top of cylinder 64 to second edge 240 approximately one hundred and forty degrees around the cylinder 64. The first edge 238 has an angled contour, as seen in FIGS. 4 and 7, which facilitates the guidance of heads 42 of ties 40 into grooves 120 of grooved cylinder 64. The first edge 238 is angled to contact heads 42 of ribbon 38 before it contacts straps 48 of cable ties 40. Thus, as grooved cylinder 64 rotates drawing ribbon 38 inward, first edge 238 initially guides and inserts head 42 of each incoming tie 40 into its respective groove 120 and subsequently guides each strap 48 into the same groove 120.

Figure 6:
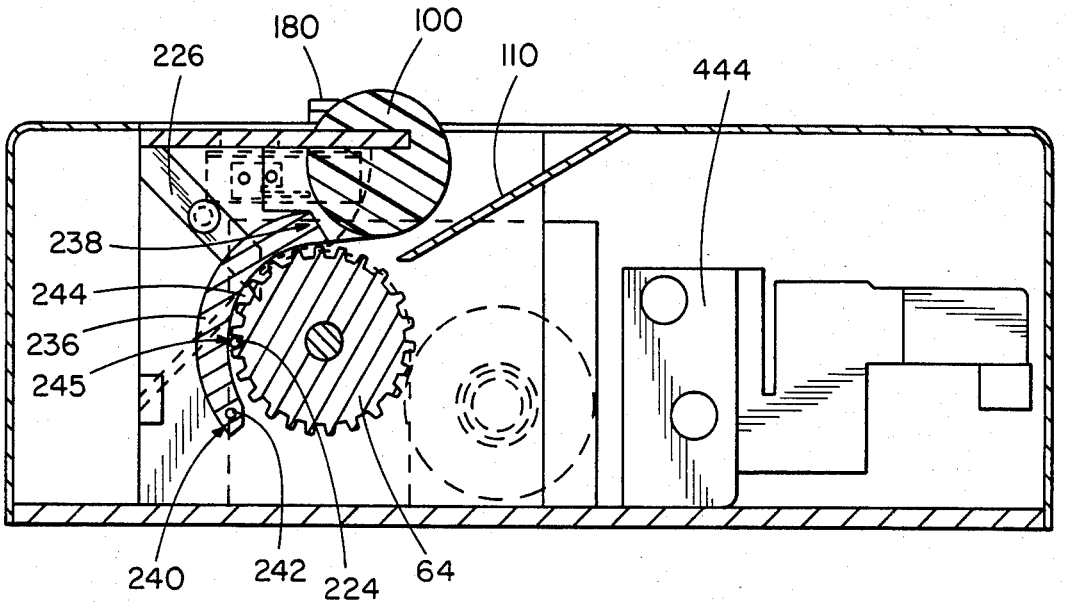
FIG. 6 is a sectional view of the dispenser mechanism of FIG. 5 taken along line 6—6 of FIG. 5.

The cover 236 is mounted on a hinge 242, as seen in FIG. 6, to allow cover 236 to be pivoted outwardly from cylinder 64 to facilitate the removal of jammed material from cylinder 64. The cover 236 does not extend past the bottom of cylinder 64, thus severed ties 40 passing beyond transfer mechanism 72 are eventually dropped from the bottom of cylinder 64 and do not interfere with continued functioning of dispenser mechanism 32. The cover 236 is positioned near enough to cylinder 64 to non-interferingly allow movement of cylinder 64 while sealingly covering a number of grooves 120 to therein define a number of channels 244.

Transfer mechanism 72 includes a source of fluid pressure (not shown) which supplies fluid pressure to orifice 224 that is positioned to introduce a primary jet of air into an aligned transfer channel 245 as it is aligned with an exit orifice 246 to eject a tie from channel 245. In preferred form, exit orifice 246 and orifice 224 are positioned at the nine o'clock position of grooved cylinder 64, looking toward index mechanism 66. Orifice 224 in lower guide plate communicates with a conduit bore (not shown) in first mounting wall 108 that carries a standard fixture (not shown). An air supply hose (not shown) is attached to the fixture to supply fluid pressure to orifice 224. The exit orifice 246 is positioned on second mounting wall 112, in line with transfer channel 245 and orifice 224. Referring now to FIGS. 11 to 14, exit orifice 246 is carried in the forward end of mounting tube 250 and is funnel shaped to ensure ease of entry of tie 40 as it is ejected from transfer channel 245 through the exit orifice 246.

Mounting tube 250 is molded to axially define a dispenser receiving tube 252. The mounting tube 250 is shaped to mate with a bore in second mounting wall 112 and a bore in manifold block 254. The mounting tube 250 has a key 256 that mates with a slot in the bore of second mounting wall 112 to ensure proper orientation of mounting tube 250 and dispenser receiving tube 252 formed therein. The dispenser receiving tube 252 has a rectangular cross section that mates with head 42 of tie 40 to orient tie 40 for later positioning in remote tool 36. The mounting tube 250 is positioned flush to the inner surface of second mounting wall 112 at its forward end and projects outwardly of the outerface 258 of manifold block 254 at its rearward end.

Towards the exit orifice 246 in mounting tube 250 is positioned a gate mechanism 260 for selectively sealing the entrance to the dispenser receiving tube 252 and a secondary air pressure supply orifice 261, being supplied in known manner with a source of pressurized air, for applying air under pressure between the gate mechanism 260 and a tie 40 carried in the dispenser receiving tube 252. It should be understood that the provision of a dispenser receiving tube 252 and a gate mechanism 260 is not absolutely necessary to the practice of this invention. Also within the concept of the present invention would be to utilize the primary air burst of transfer mechanism 72 to propel a cable tie 40 from transfer channel 245 to conveyance mechanism 34 and therethrough to remote tool 36. The provision of dispenser receiving tube 252 and gate mechanism 260 enhances the operation of the present invention by allowing concurrent provision and application of a cable tie 40 by remote tool 36 and incremental rotation of grooved cylinder 64 by index mechanism 68 to advance the subsequent tie 40 into aligned position for subsequent provision to remote tool 36; thus minimizing the length of the cycle of operation of the automatic tool 30. Additionally, the provision of gate mechanism 260 and secondary air pressure supply orifice 261 eliminates the possibility of sealing problems between cover 236 and grooved cylinder 64 (the use of a single air burst necessitating a tighter seal to ensure delivery of a tie 40 to remote tool 36) and eliminates any problems of pneumatic loading of grooved cylinder 64 due to pressurization of transfer channel 245.

Figure 13:
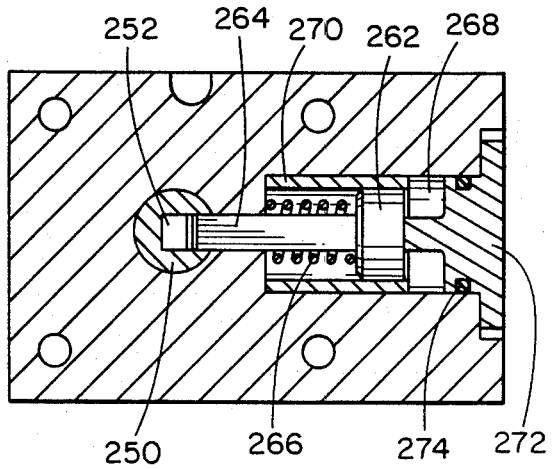
FIG. 13 is a sectional view of the manifold block of FIG. 12 as taken along line 13—13 of FIG. 12.
Figure 14:
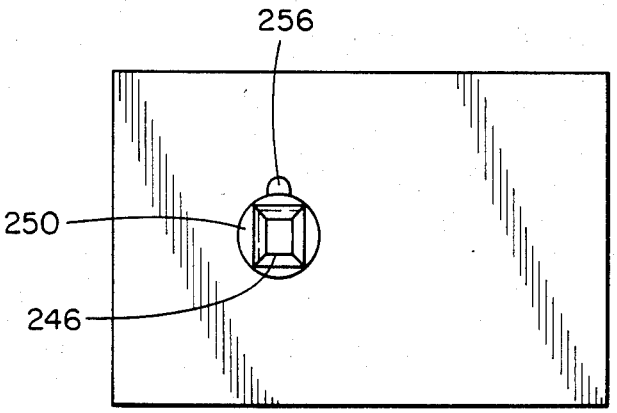
FIG. 14 is a back view of the manifold block of FIG. 11 showing the funnel shaped entrance of the exit orifice of the mounting tube.

As seen in FIG. 13, the gate mechanism 260 includes a piston 262 that strokes its rod 264 between an open and closed position; rod 264 being biased towards the open position by a spring 266. When air pressure is supplied behind piston 262 in chamber 268 rod 264 is stroked to the closed position, projecting rod 264 through a bore in mounting tube 250 and dispenser receiving tube 252 to seal dispenser receiving tube 252 from exit orifice 246 and aligned channel 244. When the supply of pressurized air is terminated, the bias of spring 266 returns rod 264 to the open position allowing communication between transfer channel 245 and dispenser receiving tube 252. The piston 262 is mounted within a bushing 270. A gate 272 having an O-ring seal 274 is fastened to manifold block 254 to define chamber 268. The manifold block 254 that mounts gate mechanism 260 and mounting tube 250 presents an outer face 258 that is structured to mate with conveyance mechanism 34. Conduits (not shown) respectively connect gripper motor air supply orifice 276, jaw cylinder air supply orifice 278 and retainer slide cylinder air supply orifice 280 to fittings 282 that are connected to air supply tubing (not shown). An electrical connector 289 is provided to mate with a corresponding connector in conveyance mechanism 34.

As seen in FIG. 7, after ties 40 are severed from ribbon 38, the remaining strip portion 44 passes down the inclined portion of channel 198 where it exits channel 198. Positioned transverse to strip portion 44 proximate the egress of channel 198 are the blades 286 of chopper mechanism 288. The chopper mechanism 288 is a standard component, blades 286 of which are actuated by the selective application of air pressure to chopper mechanism 288. The blades 286 are positioned to sever the exhausted strip portion 44 at regular intervals, the severed pieces of strip portion 44 being caught in a container positioned below the chopper mechanism 288.

Figure 15:
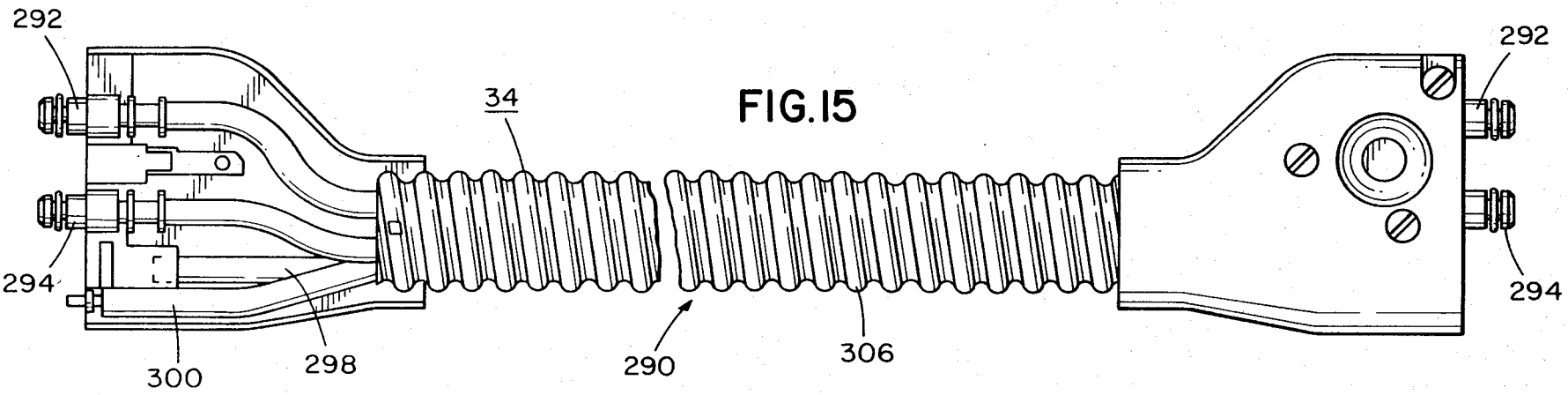
FIG. 15 is a front view of the conveyor hose of the conveyance mechanism, having one end broken away to show therein contained pneumatic tubes and electrical cable.
Figure 17:
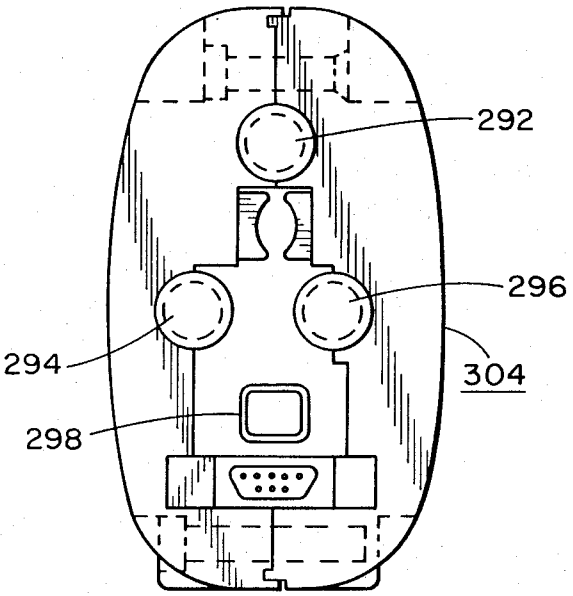
FIG. 17 is an end view of the tool end of the conveyor hose of FIG. 15.
Figure 16:
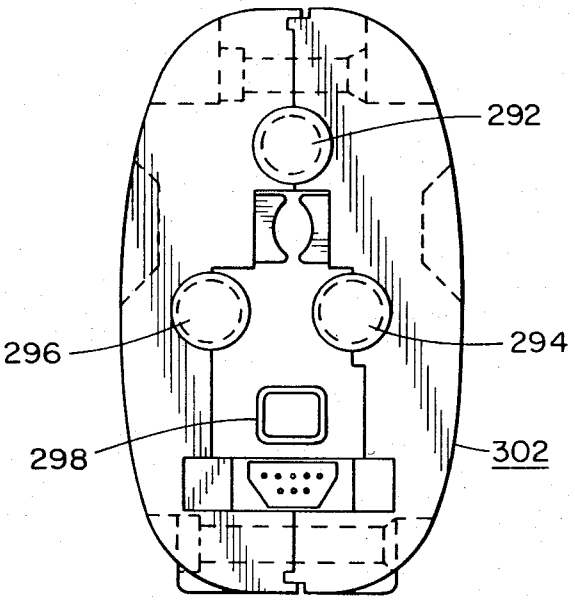
FIG. 16 is an end view of the dispenser end of the conveyor hose of FIG. 15.

The conveyance mechanism 34 best depicted in FIGS. 15, 16 and 17 includes a flexible conveyor hose 290 which contains a gripper motor air supply tube 292, jaw cylinder air supply tube 294, a retainer slide cylinder air supply tube 296, tie conveyor tube 298, and an electrical logic cable 300. Located at opposing ends of conveyor hose 290 are a dispenser hose disconnect 302 and a remote tool hose disconnect 304.

The flexible conveyor hose 290, in preferred form has a polypropylene spiral spine 306 coated with a polypropylene sheath, the pipe being of sufficient rigidity to protect the contained tubes while retaining sufficient flexibility to allow easy manipulation of remote tool 36.

Tubes 292, 294 and 296 are thermoplastic pneumatic supply tubes of normal construction. The logic cable 300 is of normal construction for transmitting electronic signals from sensors located in remote tool 36 to the control logic located in dispenser mechanism 32. The logic cable 300 only transmits low voltage and current to remote tool 36 thus presenting no safety hazard to the operator of remote tool 36.

Tie conveyor tube 298 is constructed with a rectangular cross-section complimentary to the cross-section of head 42 of tie 40. The tie 40 is presented to the conveyor tube 298 by dispenser mechanism 34 in an oriented position due to the initial positioning by the cooperation between ribbon 38, cylinder 64 and rectangular dispenser receiving tube 252. Thus each tie 40 is transported from dispenser mechanism 32 to remote tool 36 in the same oriented position.

The dispenser hose disconnect 302 and the remote tool hose disconnect 304 each removably pneumatically and electrically connects the above described tubes 292, 294, 296 and 298 and cable 284 to the respective tubes and cables of the dispenser mechanism 32 and remote tool 36.

Conveyance of tie 40 from dispenser receiving tube 252 and through conveyance mechanism 34 is accomplished by application of a secondary application of pressurized air through air supply orifice 261 located behind head 42 of tie 40 and in front of rod 264 of closed gate mechanism 260.

Referring to FIGS. 1, 18, 19, and 20, remote tool 36 generally includes a housing 309 sized to facilitate hand manipulation, an upper jaw 310, a lower jaw 312, jaw trigger 314, a remote tool hose connection 316 opposite the jaws for mating attachment to conveyance mechanism, a push-button abort switch 317 and a remote tool trigger 318. The remote tool trigger 318 when depressed translates a magnet carried thereon into operational proximity to a Hall-effect sensor that provides an actuation signal.

A mechanism for receiving the oriented tie 40 from conveyance mechanism 34 includes a steel tie receiving tube 320, a tie brake mechanism 322 and a retaining slide mechanism 324.

Figure 18:
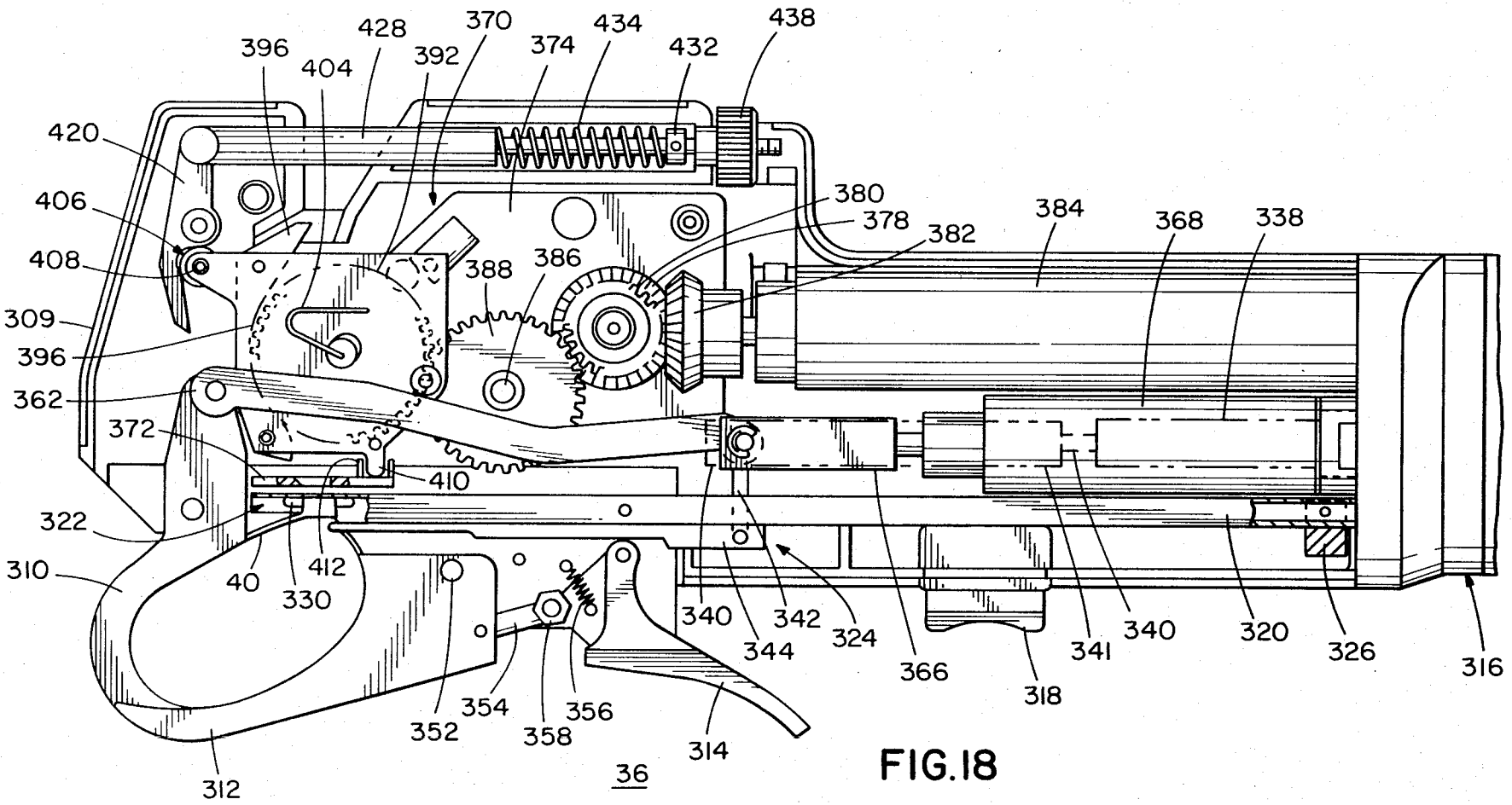
FIG. 18 is a side view of the remote tool mechanism of FIG. 1 with half of the housing of the remote tool removed, with parts removed to show the drive gears, the retaining slide; the brake mechanism and the lower jaw mechanism.
Figure 19:
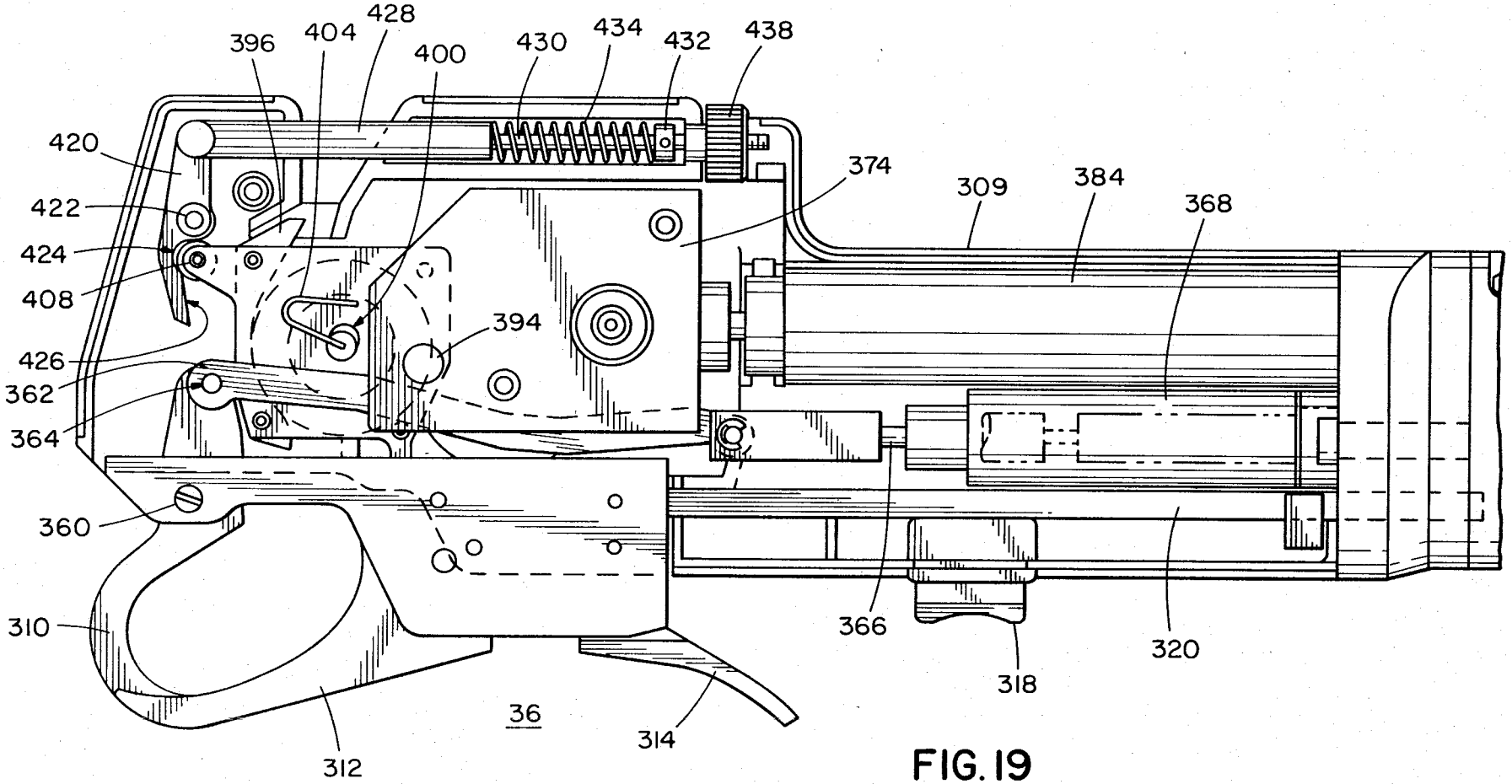
FIG. 19 is a side view of the remote tool of FIG. 1 with half of the housing of the remote tool removed.

The rectangular tie receiving tube 320 receives the oriented tie 40 provided by conveyance mechanism 34 and guides it strap first to tie brake mechanism 322 into the oriented position shown in FIG. 18. Mounted in the forward end of the receiving tube 320 is a guide 325 that directs the strap of each tie 40 downward towards the upper jaw 310. A photoelectric tie sensor 326 is mounted to the receiving tube 320 near the entrance of receiving tube 320 to provide a signal indicating when a tie 40 has entered the receiving tube 320.

Figure 21:
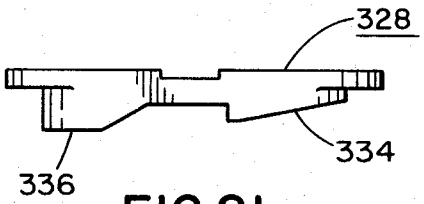
FIG. 21 is a side view of one of the brake pads utilized in the remote tool mechanism 18.
Figure 22:
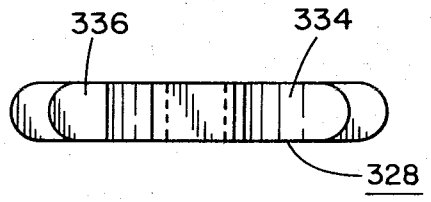
FIG. 22 is a bottom view of the brake pad of FIG. 21.
Figure 20:
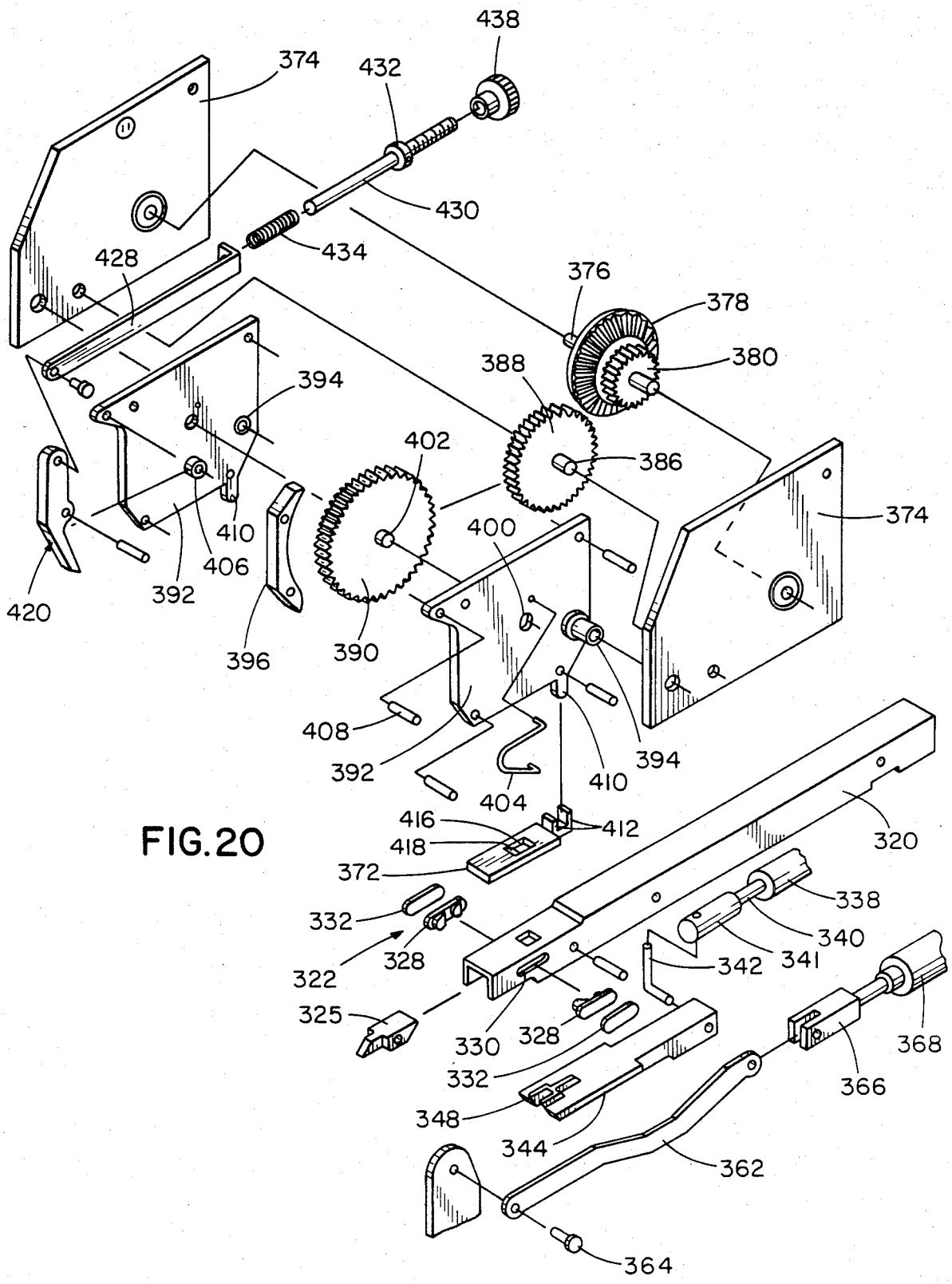
FIG. 20 is an exploded view of the internal mechanisms of the remote tool of FIG. 19.
Figures 23, 23A:
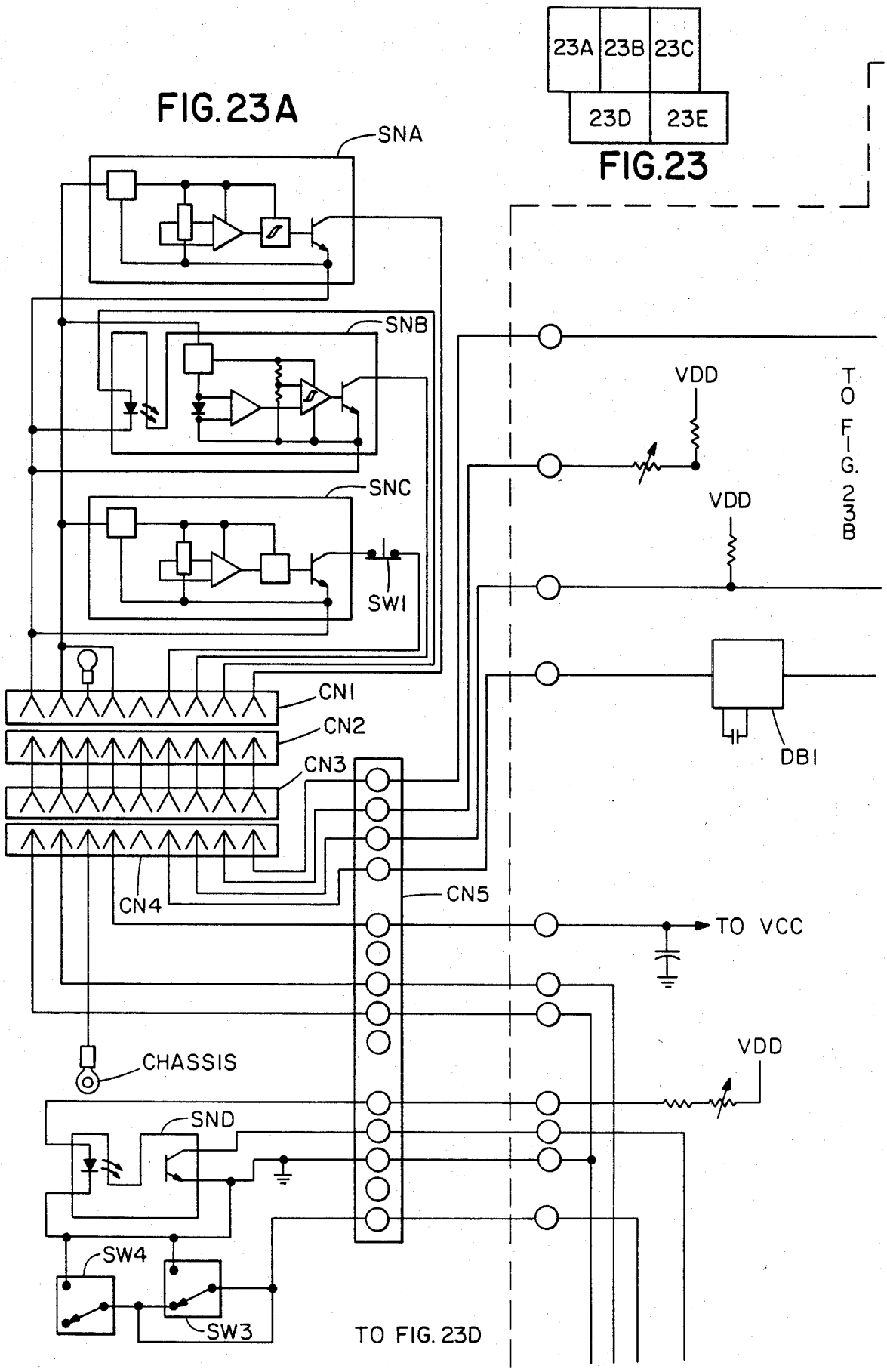
FIG. 23 is a block diagram, showing the positional relationship of FIGS. 23A–23E.
FIGS. 23A–23E are schematic diagrams that collectively define the electrical/electronic circuitry used to control the automatic tool of FIG. 1.
Figure 23B:
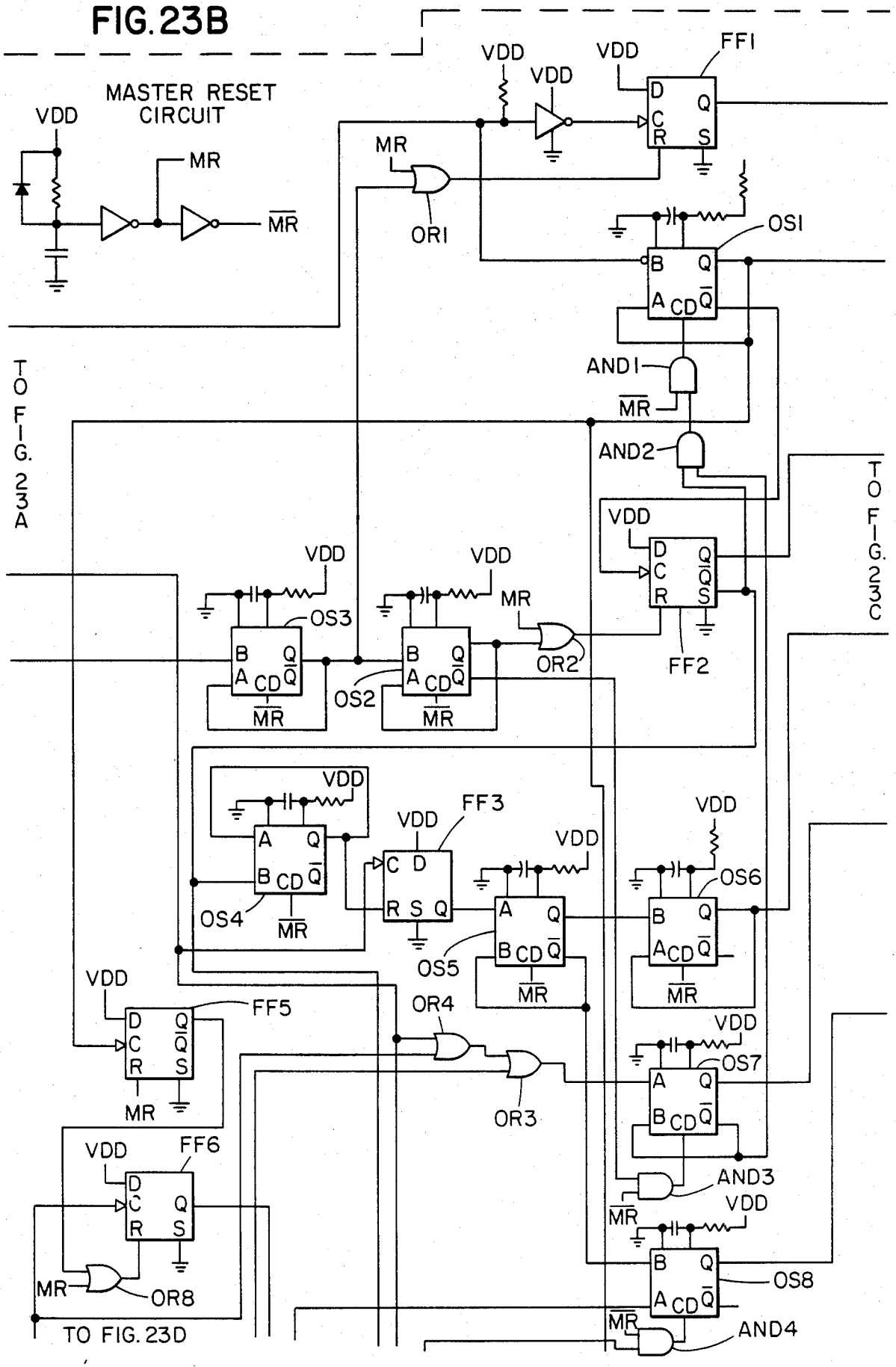
Figure 23C:
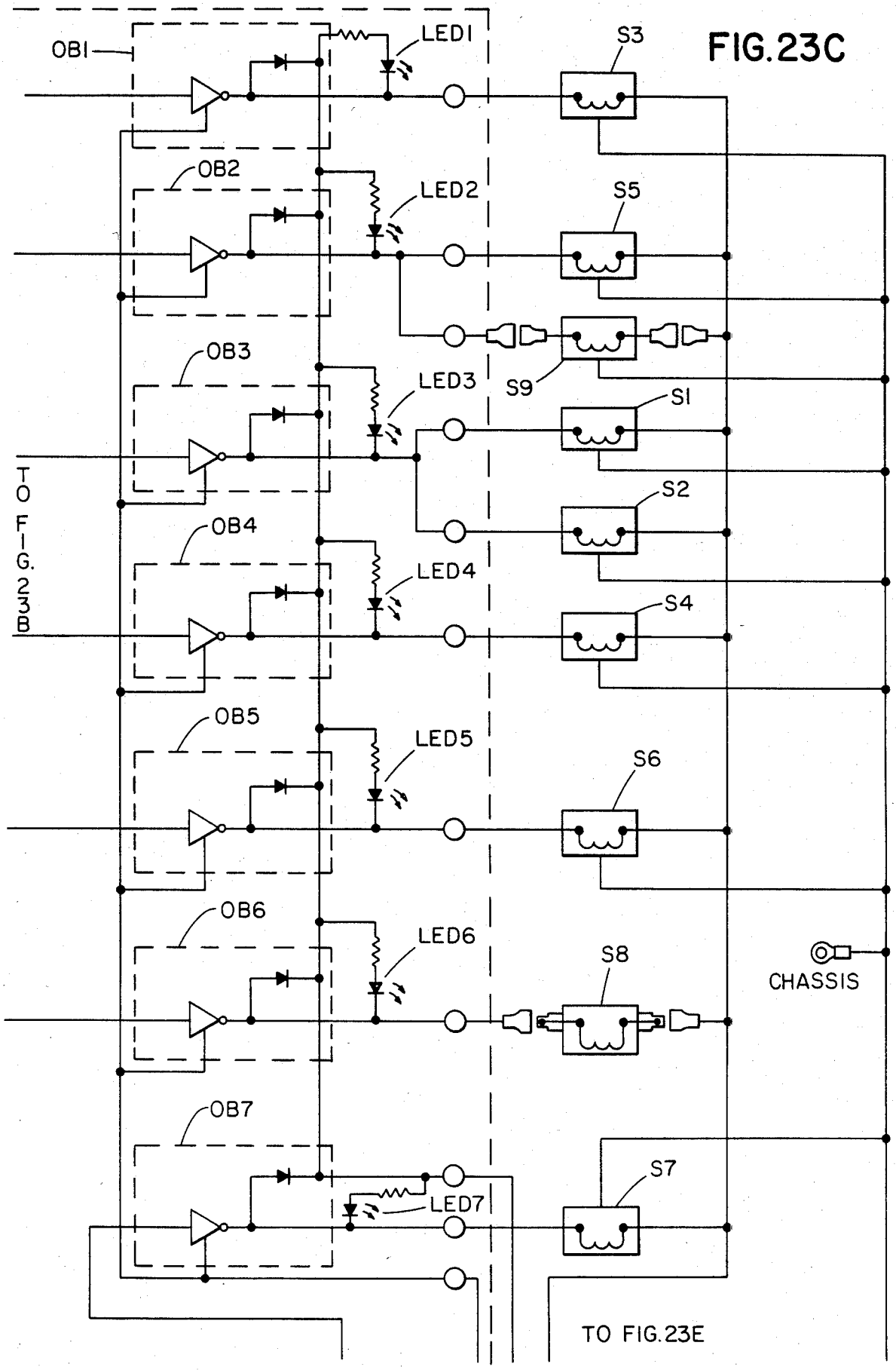
Figure 23D:
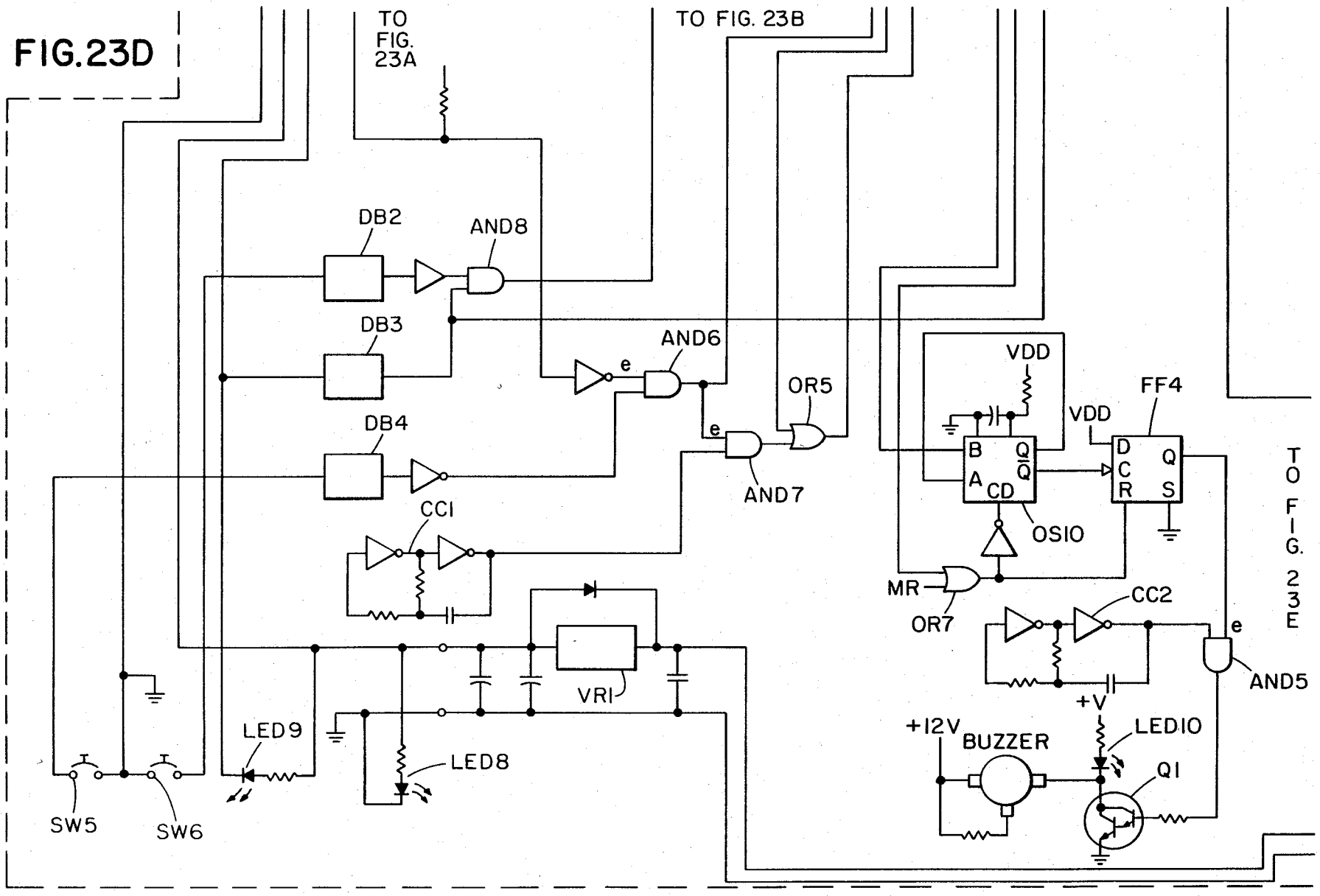
Figure 23E:
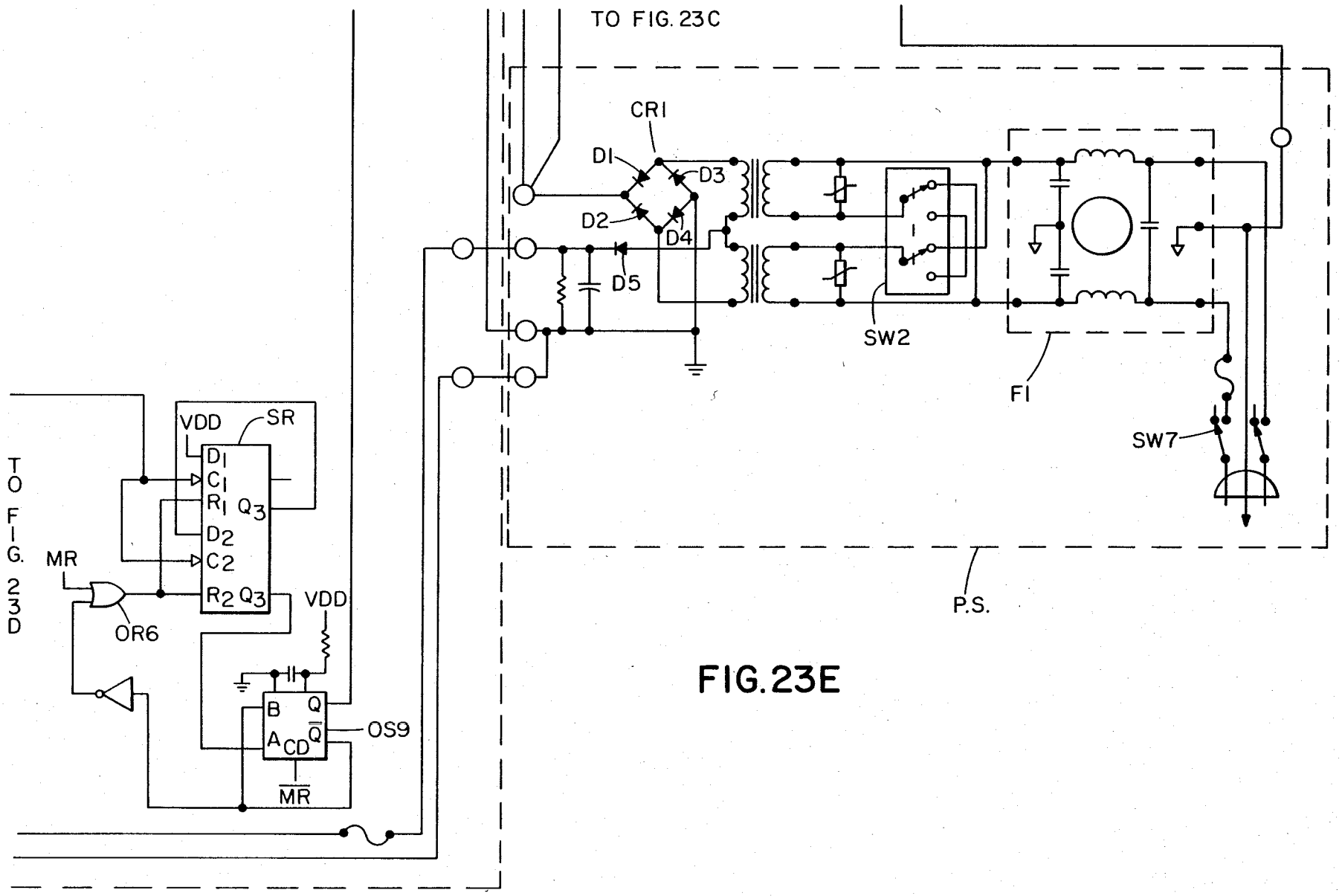

The tie brake mechanism 322 includes two brake pads 328 located on opposing sides of receiving tube 320. The brake pads 328, as seen in FIGS. 20, 21 and 22, are mounted in slots 330 in receiving tube 320 and are biased inwardly by resilient rubber pads 332. The brake pads each have a wedge shaped brake ramp 334 and a gripping tab 336 that project into receiving tube 320. The brake pads 328 are positioned proximate the jaw end of receiving tube 320 with ramps 334 projecting inwardly into receiving tube 320; both ramps 334 slope inwardly towards the jaws and together increasingly constrict the cross sectional area of receiving tube 320 in the direction of movement of tie 40. The ramps 334 gradually slow the air propelled tie 40 as it slides across the increasing constriction of opposing ramps 334, ramps 334 expanding against the bias of rubber pads 332. After the tie 40 passes over the ramps 334, it is resiliently stopped from forward movement and gripped from the side by gripping tabs 336 which position and resiliently hold tie 40 laterally in place while the forward edges of inwardly biased ramps 334 prevent retrograde movement of tie 40. The gripping force applied by brake pads 328 is not of sufficient force to interfere with the ejection of tie 40 by the secondary air burst.

As best seen in FIG. 18, retaining slide mechanism 324 includes a pneumatic retainer slide cylinder 338 having a shaft 340 that is connected to a connecting link 342 by a length adjusting spacer 341; connecting link 342 in turn driving a retaining slide 344. Retainer slide cylinder 338 is selectively supplied fluid pressure by air supply tube 296; cylinder 338 being a single acting pneumatic cylinder that is biased towards a contracted state.

The retaining slide 344 is movably positioned parallel and contiguous to the bottom of receiving tube 320 with its distal end 348 being movable between a first position allowing head 42 of tie 40 to be freely removable from receiving tube 320 and a second extended position which secures head 42 in position in receiving tube 320.

Thus the application of air pressure to retainer slide cylinder 338 strokes shaft 340 which drives the retaining slide 344 to the second position securing head 42. The removal of fluid pressure from cylinder 338 results in biased cylinder 338 retracting shaft 340 and moving the retaining slide 344 to the first position.

Positioning of tie 40 is accomplished by the operation of upper and lower jaws 310 and 312. Together the upper and lower jaws 310 and 312 have a continuous inner circumferential guide track 350 that accepts the strap 48 of tie 40 as it is propelled into position through receiving tube 320 and directs strap 48 around a circumscribed bundle towards the locking head 42 of tie 40.

The lower jaw 312 is pivotally mounted on remote tool 36 by pin 352. Jaw trigger 314 is pivotally mounted to remote tool 36 and connected to the lower jaw 312 by a link 354. Movement of the jaw trigger 314 towards remote tool 36 carries link 354 and pivots lower jaw 312 downward to open lower jaw 312 and allow the insertion of a bundle. The jaw trigger 314 is biased by spring 356 to hold jaw trigger 314 outwardly and bias lower jaw 312 towards a closed position.

Link 354 is mounted to jaw trigger 314 on an eccentric bolt 358 which allows the effective length of link 354 to be changed by turning bolt 358. The change in effective length of link 354 allows fine adjustment of the mating fit of lower jaw 312 to upper jaw 310.

The upper jaw 310 is pivotally mounted by screw 360. The upper end of upper jaw 310 is rotatably mounted to arm 362 by pin 364. The arm 362 is affixed to shaft 366 of a pneumatic jaw cylinder 368. The application of air pressure by jaw cylinder air supply tube 294 to jaw cylinder 368 strokes its shaft 366 outwardly which extends arm 362 pivoting upper jaw 310 inwardly. The shaft 366 of jaw cylinder 368 is biased towards non-extended position, causing arm 362 to return upon the removal of fluid pressure. The inward movement of upper jaw 310 drives strap 48 of a tie positioned thereon, upward through head 42. Thus selective actuation of jaw cylinder 294 results in threading a tie strap 48 into locking engagement with its head.

Provided in remote tool 36 is a gripper mechanism 370 that draws strap 48 through head 42 of tie 40 until a predetermined tension is reached and then actuates a knife 372 that cuts strap 48 adjacent the head 42 of tie 40.

The gripper mechanism 370 includes a pair of mounting plates 374 having rotatably mounted therebetween a shaft 376 that non-rotatably mounts a bevel gear 378 and a drive gear 380. Bevel gear 378 is selectively driven by a mating motor bevel gear 382 carried on the shaft of pnuematic gripper motor 384. The gripper motor 384 being a standard component that supplies rotational power upon the application of air pressure from gripper motor air supply tube 292. Forwardly rotatably mounted between mounting plates 374 is a second shaft 386 that mounts an idler gear 388 in a position to be driven by drive gear 380 and to drive a gripper gear 390.

The gripper gear 390 is supported for relative movement between a pair of gripper plates 392. The gripper plates 392 are supported for pivotal movement in remote tool 36 about a pair of pivot pins 394 and have a strap guide 396 positioned therebetween and spaced from gripper gear 390 a distance sufficient to permit movement of strap 48 of tie 40 therebetween. The gripper gear 390 is specially constructed having a pair of gripper teeth on each of its gear teeth that effect positive gripping action of strap 48.

Pivot pins 394 are positioned on the pitch line between idler gear 388 and gripper gear 390 in order to eliminate the influence of any external drive force to the gripper gear 390. The gripper plates 392 permit translational movement of gripper gear 390 relative to strap guide 396 by means of elongated slots 400 rotatably supporting the gripper gear shaft 402. Gripper gear springs 404 resiliently bias the gripper gear 390 to a position closely adjacent strap guide 396. The geometry of slots 400 is such that the gripping forces on strap 48 of tie 40 positioned between gripper gear 390 and strap guide 396 are increased upon attempted removal of strap 48 so as to provide a selfenergizing aspect to gripper gear 390. As gripper gear 390 rotates to permit removal of strap 48, a force is applied on gripper gear shaft 402 urging it to the lower portion of slots 400 wherein gripper gear teeth 398 are closer to strap guide 396. The length of strap 48 capable of being tensioned is theoretically infinite due to the rotary feed of strap 48 to gripper gear 390.

A cam follower 406 is supported by a pin 408 mounted between the forward upper end of gripper plates 392. At the lower rear of gripper plates 392 are formed knife actuators 410. Knife actuators 410 mate with arms 412 of knife 372 to slidingly drive knife 372 upon pivotal movement of gripper plates 392. The knife 372 which is reciprocatingly mounted adjacent gripper plates 392 presents an aperture 416 through which strap 48 of tie 40 is inserted by upper jaw 310. Postioned on the forward edge of aperture 416 is cutting edge 418 which severs strap 48 as knife 372 is driven to the right, as seen in FIG. 18, by pivoting gripper plates 392.

A pivot arm 420 is suitably mounted in remote tool 36 by pivot pin 422. The pivot arm 420 presents a detent 424 positioned to carry cam follower 406 and a cam surface 426 below detent 424. The detent end of pivot arm 420 is biased towards cam follower 406 by a link 428 pivotally mounted to the upper end of pivot arm 420. The link 428 selectively applies a variable biasing force to the distal end of pivot arm 420 against cam follower 406. The link 428 is disposed having a bore in its distal end to slidably accept the forward end of rod 430. Medially affixed to rod 430 is a collar 432. A spring 434 is carried on the forward end of rod 430 abuting the end of link 428 and the collar 432; thus biasing the rod 430 away from the link 428. The backward end of rod 430 is threaded to carry thumb wheel tension control 438 which is rotatably mounted in housing 308 of remote tool 36. Revolution of tie tension control 438 extends or retracts rod 430 relative to link 428 and thus compresses or expands spring 434, proving variable effective bias to pivot arm 420.

Movement of upper jaw 310 drives strap 48 of the tie 40 through head 42, knife aperture 416 and into engagement with gripper gear 390 and strap guide 396. The gripper gear 390, being driven by gripper motor 384, continues to draw the strap 48 through head 40 until tension in strap 48 is sufficient to apply a downward force on gripper plates 392 that overcomes the preset bias of pivot arm 420 and pivots the cam follower 406 out of detent 424 onto cam surface 426, thus pivoting gripper plates 392 counter-clockwise as seen in FIG. 18. The pivoting of gripper plates 392 actuates knife 372 and severs the strap 48 of tie 40 adjacent its head 42. The gripper plates 392 are then rotated back to their original position due to the bias of cam surface 426 against cam follower 406. Mounted at the top of one gripper plate 392 is a magnet. The magnet is positioned to actuate a Hall-effect gripper sensor mounted to one mounting plate 374 of remote tool 36, when gripper plates 397 pivot back to their original position after severance of strap 48 is accomplished. The gripper sensor thus provides a signal indicating the cutoff of strap 48.

The operational control of the various working mechanisms of the automatic tool 30 is provided by an electronic digital control assembly 440 mounted in dispenser mechanism 32, best seen in FIG. 5. A power supply 442 provides electrical power to the control assembly 440 by wires not shown. Based upon information received from a plurality of sensors located at various points in the mechanisms of the automatic tool 30, control assembly 440 selectively controls a plurality of solenoid actuated pneumatic valves 444, solenoid actuated single revolution clutch 130 and a plurality of auditory and visual displays. The control assembly 440 is connected to various sensing and controlled components by standard electrical wiring not shown for clarity.

The pneumatic valves 444 receive pressured air from air supply 446 and individually provide air pressure to various working mechanisms of automatic tool 30 through standard air supply conduits and fixtures that are not shown for clarity. The individual pneumatic valves are actuated by electronic logic controlled solenoids to provide air pressure to the following respective components: a first valve provides a secondary air burst to orifice 261 to convey tie from the dispenser mechanism to the remote tool, a second valve provides air pressure to gripper motor 384 to drive gripper mechanism 370 and also provides air pressure to gate mechanism 260 to seal dispenser receiving tube 252, a third valve provides air pressure to retainer slide cylinder 338 advancing retaining slide 344 and securing head 48 of tie 40, a fourth valve provides air pressure to jaw cylinder 368 causing the upper jaw 310 to pivot and insert strap 48 of tie 40 into head, a fifth valve provides a primary air burst to orifice 224 of transfer mechanism 72 to eject the tie 40 from transfer channel 245, a sixth valve provides air pressure to dispenser air motor 122 to drive index mechanism 66 and a seventh valve provides air pressure to actuate chopper mechanism 288. Air pressure is not supplied to remote tool 36 constantly, but is only supplied by pneumatic valves 444 when needed to actuate the pneumatic mechanisms, thus increasing operator safety.

In order to load the dispenser mechanism 32, an operator secures a reel 94 of ribbon 38 on the reel mechanism 62 oriented so that strip portion 44 is aligned with guide mechanism 68. The load door 100 is then pivoted upwardly to allow insertion of the distal end of ribbon 38 into grooves 120 of grooved cylinder 64 and channel 198. Handle 180 is rotated until pin 164 is removed from its index bore 162 allowing the cylinder 64 to be freely rotated without destroying the alignment between index mechanism 66 and cylinder 64. The ribbon 38 is then positioned over the cylinder 64 with the initial few ties 40 being inserted into successive grooves 120. The cylinder 64 is manually rotated until the initial tie 40 abuts the blade 226. The operator next inserts pin 164 into the closest convenient index bore 162, pivots the door 100 downwardly into its closed position and presses the load button 78 located on dispenser mechanism 32.

Acutation of load button 78 provides a signal to the control logic which consequently actuates the sixth valve providing air pressure to dispenser air motor 122 and providing rotational input to single revolution clutch 130. Simultaneously, control assembly 440 actuates the solenoid 146 of single revolution clutch 130 to index the grooved cylinder 64 1/25 of a revolution. The control assembly 440 continues to index the cylinder 64 until a signal is received from the strip sensor indicating the distal end of the strip portion 44 has reached the strip sensor. At this point, a severed tie 40 is positioned in a transfer channel 245 aligned with exit orifice 246 and automatic tool 30 is loaded and ready to install ties 40.

Referring now to FIGS. 23 and 23A–23E, the electrical/electronic circuitry used in automatic cable tie installation tool 30 assembly of the present invention is schematically depicted. The circuitry includes a power supply PS for supplying direct current to the coils of a plurality of output solenoids S1 through S9 which control various mechanical and pneumatic operations of the automatic tool 30. The power supply further provides lower voltage direct current for various sensors SNA through SND and for a logic circuit which is responsive to the output of the sensors to selectively energize the solenoid coils. The logic circuit is also responsive to the operation of various safety and special functions switches, SW1, SW3–SW6.

More specifically, solenoid S3 controls operation of retaining slide 344 for retaining head 42 of cable tie 40 in remote tool 36 adjacent upper and lower jaws 310 and 312; solenoid S5 controls application of a primary air burst for moving cable tie 40 disposed in the transfer channel 245 past gate mechanism 260 and into position to be transferred to remote tool 36 by a secondary air burst; solenoid S1 controls the secondary air burst; solenoid S2 controls application of air to power gripper motor 384 and gate mechanism 260; solenoid S4 functions to supply air to jaw cylinder 368 which moves the upper jaw 310 to thread strap 48 of a cable tie 40 into its locking head 42; solenoid S6 controls application of air to dispenser air motor 122; solenoid S8 energizes single revolution clutch 130 to couple dispenser air motor 122 to grooved cylinder 64 through planetary gear assembly 134; solenoid S9 controls a cable tie counter; and solenoid S7 advances chopper mechanism 288. The trio of sensors located in the tool include: Hall-effect sensor SNA which provides an output in response to actuation of the tool trigger 38; photoelectric sensor SNB which detects completion of transmission of a cable tie 40 from dispenser mechanism 32 to remote tool 36; and a Hall-effect sensor SNC positioned to detect completion of cutoff of the excess threaded strap 48 of a tensioned cable tie 40. A fourth sensor, photoelectric sensor SND, is disposed in dispenser mechanism 32 to detect the absence of strip portion 44 of ribbon 38.

A push-button abort switch SW1, biased to its closed position, is located on the remote tool 36 to interrupt the output of tie cutoff sensor SNC, to provide means for manually interrupting the tool cycle in case of a malfunction. A pair of two position safety switches SW3 and SW4 are positioned in the dispenser mechanism 32 to prevent operation of single revolution clutch 130 if pin 164 of locking pin assembly 156 is removed from index bores 162 of planetary gear assembly 134 or if dispenser load door 100 is open, respectively. Positioned on the dispenser housing 74 are a push-button load switch SW5 effecting initial loading of cable ties 40 in grooved cylinder 64, and a push-button reset switch SW6 to advance grooved cylinder 64 only one position after a cable tie jam condition has been corrected.

The power supply includes a transformer T1 for supplying power to the logic circuit, sensors, and coils of solenoids S1 through S9. The transformer has a pair of primary windings connected to receive line voltage through a radio frequency interference filter F1 and a power switch SW7 is provided for selectively energizing the power supply. Line voltage of either a nominal 115 or 230 volts A.C. is acceptable and the power supply includes a double pole, double throw switch SW2 for placing the primary winding of the transformer in series for the higher line voltage and in parallel for the lower line voltage. The output of transformer T1 is connected to power the various solenoid coils through a center tapped full wave recitifier CR1 and a plurality of output buffers OB1 through OB7. The output of transformer T1 is also provided to the logic circuitry through only diodes D3 and D4 of the full wave rectifier CR1, a diode D5 to isolate the logic circuitry from voltage spikes caused by the solenoid coils, a capacitor filter and a voltage regulator VR1.

The sensors positioned in remote tool 36 are connected to the logic circuit, which is located in dispenser mechanism 32, through connector CN1 disposed at the hose-receiving end of remote tool 36, connectors CN2 and CN3 positioned one at each end of conveyor hose 290, dispenser connector CN4 and logic circuit connector CN5. The logic circuit is preferably of the type fabricated using complimentary metal oxide semiconductor (CMOS) techniques and includes a master reset subcircuit for providing a square wave pulse at its MR output and in inverted wave pulse at its $\overline{MR}$output for resetting the various monostable (one-shot) multivibrators and bistable multivibrators (flip-flops) in the logic circuit, as is necessary to place these components in their proper electronic condition upon initial application of power or upon recovery from a power outage. For purposes which will be apparent to those skilled in the art, debouncing circuits are provided in series with various switches.

Tool trigger sensor SNA is connected to retaining slide solenoid S3 through an inverter, a flip-flop FF1 and an output buffer OB1; to primary air burst solenoid S5 and dispenser cycle counter solenoid S9 through one-shot multivibrator OS1 and output buffer OB2; and to secondary air burst solenoid S1 and gripper motor 384 and gate solenoid S2 through OS1, flip-flop FF2 and output buffer OB3. The output of tie sensor SNB controls operation of dispenser air motor solenoid S6 through gates OR4 and OR3, one-shot multivibrator OS7 and output buffer OB5; of single revolution clutch solenoid S8 through flip-flop FF3, one-shot multivibrators OS5 and OS8 and output buffer OB6; and of tool jaw cylinder solenoid S4 through flip-flop FF3, one-shot multivibrators OS5 and OS6, and output buffer OB4. Also an output from tie cutoff sensor SNC controls operation of retainer slide solenoid S3 through one-shot multivibrator OS3, gate OR1, flip-flop FF1 and output buffer OB1; of dispenser air motor solenoid S6 through one-shot multivibrator OS3 and OS2, gate AND3, one-shot multivibrator OS7 and output buffer OB5; and of secondary air burst solenoid S1 and gripper motor 384 and gate solenoid S2 through one-shot multivibrators OS3 and OS2, gate OR2, flip-flop FF2 and output buffer OB3.

Load switch SW5 is connected to control operation of dispenser air motor solenoid S6 through an inverter, gate AND6, gate OR3, one-shot multivibrator OS7 and output buffer OB5. However, gate AND6 is enabled only when dispenser strip sensor SND detects the absence of the strip portion 44 in inclined portion 212 of channel 198. The output of gate AND6 enables gate AND7 which, along with gate OR5, one-shot multivibrator OS8 and output buffer OB6, connects single revolution clutch solenoid S8 to clocking circuit CC1. However, OS8 is enabled through AND4 only when safety switch SW4 indicates dispenser load door 100 is closed, and safety switch SW3 senses planetary gear assembly 134 is engaged by locking pin 164. Thus, after the strip portion 44 is initially manually fed into the channel 198 of guide mechanism 68 and the attached ties 40 placed into grooved cylinder 64, the planetary gear assembly 134 is engaged, and load door 100 is closed; operation of the load switch SW5 turns on dispenser air motor 122 and provides clock pulses to activate single revolution clutch 130. When strip sensor SND detects that loading has been completed, it disables gate AND6 to shut off clutch 130, and dispenser air motor 122 turns off after the RC time delay associated with one-shot multivibrator OS7 has expired.

Reset switch SW6 is connected to dispenser air motor solenoid S6 through an inverter; gates AND8, OR4 and OR3; one-shot multivibrator OS7 and output buffer OB5. Gate AND8 is enabled only when dispenser load door 100 is closed and planetary gear assembly 134 engaged. The output of gate AND8 controls operation of solenoid S8 for single revolution clutch 130 through flip-flop FF6, gate OR5, one-shot multivibrator OS8 and output buffer OB6. Operation of the reset switch causes dispenser air motor 122 to energize momentarily and single revolution clutch 130 to receive a pulse to advance only a single cable tie 40 as is necessary after correction of the cable tie jam condition. It should be noted that reset switch SW6 can only be used to advance one cable tie 40 after a power interruption and is disabled after the first operation of the system. Tool trigger sensor SNA is connected to flip-flop FF6 through one-shot multivibrator OS1, flip-flop FF5 and gate OR8. Correction of a jam condition requires detachment of conveyor hose 290 which interrupts power to the logic circuit. Upon reattachment of conveyor hose 290, logic circuit power is restored and reset switch SW6 can be used to advance a single cable tie 40. However, actuation of the tool trigger 318 causes flip-flop FF5 to apply a signal to the reset input of flip-flop FF6, thereby preventing its further switching.

An alarm circuit is utilized to provide audible and visual indication that the dispenser is empty or that a jam condition exists. This circuit includes a buzzer and a light emitting diode connected to be energized when a Darlington amplifier Q1 is rendered conductive by receiving pulses from clock circuitry CC2 through gate AND5. Gate AND5 is enabled by flip-flop FF4, the operation of which is in turn governed by one-shot multivibrator OS10. Flip-flop FF2 provides a signal to OS10 when the secondary air burst is applied. The "circuit defeat" input of OS10 is connected through an inverter and gate OR7 to receive a signal from tie sensor SNB that a cable tie 40 has been received in remote tool 36. The time delay RC circuit connected to one-shot multivibrator OS10 provides a delay greater than the time required for a tie 40 to be transmitted from the dispenser gate to the tool member. Thus if OS10 does not receive a signal that a tie 40 has been received by remote tool 36 within the period of the time delay after the secondary air burst is applied, gate AND5 is enabled causing energization of the alarm circuit.

The logic circuit also controls operation of the dispenser strip chopper solenoid S7 to effect cutting of strip portion 44 of ribbon 38, after ties 40 have been removed, in response to a predetermined number of tool operational cycles. Chopper solenoid S7 is connected to tool trigger sensor SNA through one-shot multivibrator OS1, a shift register SR, one-shot multivibrator OS9 and output buffer OB7. The shift register is connected to provide an output for each eight input signals it receives. Thus, on the eight actuation of tool trigger 318, the shift register causes OS9 to provide a pulse causing operation of chopper mechanism 288. One-shot multivibrator OS9 also provides a feed-back signal through an inverter and gate OR6 causing the shift register to reset.

Normal operation of the circuitry when dispenser mechanism 32 is loaded is as follows: Upon actuation of tool trigger 318, sensor SNA provides a signal causing flip-flop FF1 to energize retaining slide solenoid S3 and additionally causes multivibrator OS1 to provide an output causing primary air burst solenoid S5 to move a cable tie 40 to the downstream side of gate mechanism 260. After the time delay associated with multivibrator OS1 has expired, the solenoid S5 is deenergized and flip-flop FF2 energizes gripper motor 384 and gate solenoid S2 closing gate mechanism 260 and secondary air burst solenoid S1 to transmit cable tie 40 through tie conveyor tube 298 to remote tool 36.

Upon the tie being received by remote tool 36, photoelectric sensor SNB provides a signal to multivibrator OS7 which energizes dispenser air motor solenoid S6. At the same time, multivibrator OS8 provides a pulse to momentarily energize single revolution clutch solenoid S8 to cause dispenser air motor 122 to move grooved cylinder 64 to advance one cable tie 40. After expiration of the time delay associated with multivibrator OS5, multivibrator OS6 provides a pulse to energize tool jaw cylinder solenoid S4 causing the distal end of cable tie 40 to be inserted through cable tie head 42 and into position to be received by gripper mechanism 370.

After gripper mechanism 370 achieves a predetermined strap tension in strap 48, the excess threaded portion of strap 48 is severed. Hall-effect sensor SNC is responsive to this cutoff to provide a signal resetting flip-flop FF1 causing deenergization of the retaining slide solenoid S3 to release head 42 of the applied cable tie 40. The head 42 is thus propelled from remote tool 36 by the continued application of pressurized air by the secondary air burst. After expiration of the time delay associated with multivibrator OS3, multivibrator OS2 sends a signal to the "circuit defeat" input of multivibrator OS7 turning off dispenser air motor solenoid S6. Concurrently, multivibrator OS2 resets flip-flop FF2 resulting in deenergization of the secondary air burst solenoid S1 and gripper motor and gate solenoid S2 to open the dispenser cable tie gate. Thus, the automatic tool 30 is placed in condition to start another operational cycle in response to actuation of tool trigger 318.

The logic circuitry also includes components for safety and for preventing inconsistent concurrent operation of other components. More specifically, the "circuit defeat" input of one-shot multivibrator OS1 is connected to flip-flop FF2 and one-shot multivibrator OS7 through gates AND1 and AND2. During normal operation of the system, this prevents the primary air burst, once turned off during a cycle of operation, from being turned on again until that cycle of operation is completed. The presence of gates AND1 and AND2 is also useful in the event the operator has used the dispenser reset function and attempts to start a normal cycle of operation by depressing the tool trigger 318 before the dispenser reset function has been completed. Gates AND1 and AND2 insure that one-shot multivibrator OS1 can never be on concurrently with one-shot multivibrator OS7 to preclude application of the primary air burst when dispenser air motor 122 is running. This insures that a normal cycle cannot be initiated until the dispenser reset function has completed advancement of the next cable tie 40 into proper position.

Gate AND4 interconnects the "circuit defeat" input of one-shot multivibrator OS8 with dispenser load door safety switch SW4 and planetary gear assembly safety switch SW3. In the event that operator depressed either load switch SW5 or dispenser reset switch SW6, and prior to completion of the load or reset function, the operator opened load door 100 or disconnected planetary gear assembly 134, gate AND4 would immediately deenergize single revolution clutch solenoid S8.

One-shot multivibrator OS4 is connected between flip-flop FF2 and flip-flop FF3. OS4 is responsive to switching of flip-flop FF2 to enable flip-flop FF3 to energize one-shot multivibrator OS6 and OS8 when tie sensor SNB indicates a tie has been received by remote tool 36. Thus, OS6 and OS8 can turn on tool jaw cylinder solenoid S4 and single revolution clutch solenoid S8 only once after actuation of tool trigger 318. One-shot multivibrator OS4 was included to prevent a second energization of S4 and S8 (which might startle the operator) in the following highly improbable situation: A tie 40 goes into remote tool 36 past sensor SNB but fails to be received by tool brake mechanism 322. The operator pushes tool reset switch SW1 to end the cycle of operation. The operator tilts the tool backwards causing the tie to regress past tie sensor SNB. If not for the presence of one-shot multivibrator OS4, a second energization of tool upper jaw 310 and dispenser air motor 122 might occur.

What is claimed is:

1. An automatic cable tie installation tool for fastening a discrete cable tie around a bundle of wires or the like, comprising:

dispenser means for accepting a ribbon of cable ties having a laterally disposed strip portion of sufficient rigidity to define a substantially planar ribbon, wherein said cable ties extend from said strip portion and are connected to said strip portion by connecting means, said dispenser means including separating means for removing individual cable ties from said ribbon whereby said dispenser means provides discrete cable ties from said ribbon;

tool means for positioning, tensioning and severing the tail of the discrete cable tie provided by said dispenser means around the bundle of wire or the like, said dispenser means being spaced from said tool means and not being supported by said tool means; and tubular conveyance means for delivering the discrete cable tie provided by said dispenser means to said tool means.

2. An automatic cable tie installation tool as set forth in claim 1, wherein said dispenser means further comprises:

means for providing the ribbon to said dispenser;

transfer means for delivering discrete severed ties to said conveyance means; and means for accurately positioning and sequentially carrying the individual ties on the ribbon to said separating means and said transfer means.

3. An automatic cable tie installation tool as set forth in claim 2, wherein said means for positioning and carrying the individual ties to said separating means and said transfer means comprises:

a cylinder having longitudinal splines that define grooves for carrying the individual ties; and index means for rotating said cylinder in accurate increments.

4. An automatic cable tie installation tool as set forth in claim 3, comprising guide means for positioning the ribbon relative to said separating means to ensure accurate separation of the individual ties from the strip portion of the ribbon, said guide means aligningly engaging the strip portion of the ribbon.

5. An automatic cable tie installation tool as set forth in claim 4, wherein said tool means comprises:

receiving means for receiving cable tie from said dispensing means;

positioning means for positioning said cable tie in a closed loop about the bundle of wires or the like;

tensioning means for tensioning the cable tie about the bundle of wires or the like; and tail cutting means for cutting the tail of said cable tie once it has been tensioned about the bundle of wire or the like.

6. An automatic cable tie installation tool as set forth in claim 5, wherein said separating means comprises a knife positioned transverse to the ribbon, said cylinder carrying the ribbon into contact with said knife to sequentially sever individual ties from the strip portion.

7. An automatic cable tie installation tool as set forth in claim 6 wherein said dispensing means comprises a cover that matingly covers at least one of said grooves, as said groove is indexed under said cover, to define a transfer channel.

8. An automatic cable tie installation tool as set forth in 7, wherein said transfer means comprises:

gate means for selectively allowing or disallowing communication between said transfer channel and said conveyance means; and a source of fluid pressure adapted to direct pressurized fluid into said transfer channel containing a severed tie, thus propelling said tie out of said transfer channel, past said open gate means and into said conveyance means.

9. An automatic cable tie installation tool as set forth in claim 8, wherein said conveyance means comprises:

a tube connecting said dispenser means and said tool means; and a source of fluid under pressure adapted to be injected into said tube between said closed gate means and a cable tie positioned in said tube to propel the cable tie through said tube to said tool means.

10. An automatic cable tie installation tool as set forth in claim 9 wherein said index means rotates said cylinder to carry the ribbon past said knife to sequentially sever each tie and sequentially deliver each discrete tie into alignment with said cover and said transfer means.

11. An automatic cable tie installation tool as set forth in claim 10, wherein said guide means comprises an upper guide plate and a lower guide plate which together present complimentary edges that define an alignment channel shaped to mate with the strip portion of the ribbon to accurately carry the ribbon and position the ribbon laterally.

12. An automatic cable tie installation tool as set forth in claim 11, wherein said index means comprises:

motor means;

clutch means; and gear means, said motor means providing rotational movement to said clutch means, said clutch means selectively transfering rotational movement supplied by said motor means to said gear means in one revolution increments, said gear means reducing the one revolution movement supplied by said clutch means to a fraction of one revolution and supplying the fractional rotation to said cylinder.

13. An automatic cable tie installation tool as set forth in claim 12 wherein said gear means is a planetary gear assembly and further comprising detachment means for providing selective rotational detachment and attachment of said index means to said cylinder means while ensuring proper alignment between said index means and said cylinder means, said detachment means including an index ring secured to a ring gear of said planetary gear assembly, and a locking pin, said index ring having bores spaced around the outer circumference of said index ring and said locking pin being selectively insertable into said bores to lock said index ring and said ring gear from movement.

14. An automatic cable tie installation tool as set forth in claim 13, wherein the distance between said knife and the tie is adjustable, allowing variable adjustment of desired closeness of severance of the tie from the ribbon; and wherein said alignment channel has an I-shaped cross section.

15. An automatic cable tie installation tool as set forth in claim 14, comprising:

means for intially decelerating, stopping and gripping said cable tie to correctly position said cable tie in said tool means and to minimize the likelihood of impact damage to said cable tie due to abrupt deceleration; said means having opposing pads, each of said pads having an inwardly directed ramp and an inwardly directed gripping tab, said ramps of said opposing pads effecting deceleration of the cable tie and said tabs of said opposing pads stopping the forward motion of the cable tie and gripping the cable tie; and each of said pads being resiliently mounted to bias said pads toward said cable tie.

16. An improvement in a cable tie installation tool having a tool member for positioning, tensioning and severing the tail of a cable tie around a bundle of wires or the like, the tool member having a cable tie receiving tube for orienting and positioning the cable tie in the tool member, the cable tie being provided to the receiving tube by a propulsion means at a velocity sufficient to propel the cable tie through the receiving tube and into position in the tool member, said improvement comprising:

means for decelerating, stopping and gripping the cable tie as it passes through the receiving tube to correctly position the cable tie in the tool member and to minimize the likelihood of impact damage to the cable tie due to abrupt deceleration; said means having opposing pads, each of said pads having an inwardly directed ramp and an inwardly directed gripping tab, said ramps of said opposing pads effecting deceleration of the cable tie and said tabs of said opposing pads stopping the forward motion of the cable tie and gripping the cable tie; and each of said pads being resiliently mounted in a manner to project said ramps and said gripping tabs into the receiving tube and to resiliently bias said pads inwardly.

17. A tool as set forth in claim 16, wherein said ramps project into the receiving tube, said ramps having wedge-shaped profiles that together increasingly constrict the cross sectional area of the receiving tube in the direction of movement of the cable tie.

18. A tool as set forth in claim 17, wherein said gripping tabs are positioned stop the cable tie after the cable tie has passed over said ramps and to resiliently grip the cable tie, and wherein said resiliently biased ramps prevent backward movement of said cable tie.

19. A tool as set forth in claim 18, wherein said pads are mounted on opposing sides of the receiving tube.

20. A tool as set forth in claim 19, wherein said pads are each resiliently mounted on a rubber pad.

* * * * *